US006057824A

United States Patent [19]

Katakura et al.

[11] Patent Number: 6,057,824

[45] Date of Patent: May 2, 2000

[54] DISPLAY APPARATUS HAVING FAST REWRITE OPERATION

[75] Inventors: Kazunori Katakura, Atsugi; Yutaka Inaba, Kawaguchi, both of Japan

[73] Assignee: Canon Kabushiki Kaisha, Tokyo, Japan

[21] Appl. No.: 08/946,644

[22] Filed: Oct. 7, 1997

Related U.S. Application Data

[63] Continuation of application No. 08/352,590, Dec. 9, 1994, abandoned.

[30] Foreign Application Priority Data

Dec. 14, 1993 [JP] Japan ..... 5-342064
Dec. 22, 1993 [JP] Japan ..... 5-346596

[51] Int. Cl.[7] ..... G09G 3/36

[52] U.S. Cl. ..... 345/100; 345/89

[58] Field of Search ..... 345/89, 98–100

[56] References Cited

U.S. PATENT DOCUMENTS

| | | | |
|---|---|---|---|
| 4,367,924 | 1/1983 | Clark et al. . | |
| 4,655,561 | 4/1987 | Kanbe et al. . | |
| 4,709,995 | 12/1987 | Kuribayashi et al. . | |
| 4,800,382 | 1/1989 | Okada et al. . | |
| 4,836,656 | 6/1989 | Mouri et al. . | |
| 4,923,759 | 5/1990 | Brooks et al. . | |
| 4,938,754 | 7/1990 | Mesek . | |
| 5,058,994 | 10/1991 | Mihara et al. . | |
| 5,132,817 | 7/1992 | Inaba . | |
| 5,172,105 | 12/1992 | Katakura et al. . | |
| 5,172,107 | 12/1992 | Kanno et al. | 345/100 |
| 5,359,344 | 10/1994 | Inoue et al. | 345/100 |

FOREIGN PATENT DOCUMENTS

| | | |
|---|---|---|
| 0306011 | 3/1989 | European Pat. Off. . |
| 0318050 | 5/1989 | European Pat. Off. . |
| 0319291 | 6/1989 | European Pat. Off. . |
| 60-69036 | 4/1985 | Japan . |
| 61-9023 | 1/1986 | Japan . |
| 62-56936 | 3/1987 | Japan . |
| 64-61180 | 3/1989 | Japan . |
| 5127623 | 5/1993 | Japan . |
| 2164776 | 3/1986 | United Kingdom . |
| WO9527971 | 10/1995 | WIPO . |

OTHER PUBLICATIONS

N. Clark, et al., "Submicrosecond Bistable Electro–Optic Switching in Liquid Crystals", Applied Physics Letters, vol. 36, No. 11, pp. 899–901 (Jun. 1980).

Kotai Butsuri, "Liquid Crystals", Solid State Physics, vol. 16, pp. 141–151 (1981).

R.B. Meyer, et al., "Ferroelectric Liquid Crystals", Le Journal de Physique Lettres, vol. 36, pp. 69–71 (Mar. 1975).

*Primary Examiner*—Jeffery Brier

*Attorney, Agent, or Firm*—Fitzpatrick, Cella, Harper & Scinto

[57] ABSTRACT

A display apparatus includes a display panel having pixels formed at each intersection of scanning electrodes and data electrodes, and a driver for driving the display panel so that a period of each pixel placed in a prescribed display state is determined within a frame period depending on given gradation data. The driver divides one frame period into a first plurality of equivalent blocks of which a second plurality, smaller in number than the first plurality, of mutually non-neighboring blocks are allotted to a partial rewriting for selecting scanning electrodes corresponding to pixels to change display states. The remaining blocks other than the second plurality of blocks are allotted to an entire picture scanning for selecting all the scanning electrodes. Each scanning electrode is subjected to a plurality of selections during the entire picture scanning and during the partial rewriting so as to allow display of an identical number of gradation levels both in the entire picture scanning and in the partial rewriting.

7 Claims, 31 Drawing Sheets

| PIXEL | DATA |
|---|---|
| $A_{11}$ | 0 1 0 |
| $A_{12}$ | 0 1 0 |
| $A_{13}$ | 0 0 1 |
| $A_{14}$ | 1 0 0 |
| $A_{21}$ | 1 1 0 |
| $A_{22}$ | 0 1 1 |
| $A_{23}$ | 1 0 1 |
| $A_{24}$ | 1 0 1 |
| $A_{31}$ | 0 1 1 |
| $A_{32}$ | 0 1 1 |
| $A_{33}$ | 1 0 0 |
| $A_{34}$ | 0 0 1 |
| $A_{41}$ | 0 0 0 |
| $A_{42}$ | 1 1 1 |
| $A_{43}$ | 0 1 1 |
| $A_{44}$ | 1 1 0 |

FIG. 4

| | | | |
|---|---|---|---|
| 0 | 0 | 0 | 1 |
| 1 | 0 | 1 | 1 |
| 0 | 0 | 1 | 0 |
| 0 | 1 | 0 | 1 |

M3

FIG. 5A

| | | | |
|---|---|---|---|
| 1 | 1 | 0 | 0 |
| 1 | 1 | 0 | 0 |
| 1 | 1 | 0 | 0 |
| 0 | 1 | 1 | 1 |

M2

FIG. 5B

| | | | |
|---|---|---|---|
| 0 | 0 | 1 | 0 |
| 0 | 1 | 1 | 1 |
| 1 | 1 | 0 | 1 |
| 0 | 1 | 1 | 0 |

M1

FIG. 5C

| | | | |
|---|---|---|---|
| 3/9 | 3/9 | 1/9 | 5/9 |
| 8/9 | 4/9 | 6/9 | 6/9 |
| 4/9 | 4/9 | 5/9 | 1/9 |
| 0/9 | 9/9 | 4/9 | 8/9 |

DISPLAY APPARATUS HAVING FAST REWRITE OPERATION

This application is a continuation of application No. 08/352,590, filed Dec. 9, 1994, now abandoned.

FIELD OF THE INVENTION AND RELATED ART

The present invention relates to a display apparatus for use in a terminal monitor for a computer, a view finder for a video camera, a light valve for a projector, a television receiver, a car navigation system, etc., particularly a display apparatus capable of gradational display by controlling the time duration of each pixel assuming a bright or a dark state.

Hitherto, as a method of apparently effecting a gradational display in a display apparatus inherently having no capability of gradational display, there has been known a method of modulating (changing) the ratio of time durations for displaying two states, e.g., a white display and a dark display. This is generally called a time modulation, frame modulation or frame thinning-out scheme and is disclosed in, e.g., Japanese Laid-Open Patent Application (JP-A) 61-69036. According to this scheme, however, an additional time is required corresponding to an increase in number of gradation levels, and a time required for a display of 8 gradations or gradation levels at a pixel amounts to a time corresponding to 7 frames according to the conventional binary display scheme.

In contrast thereto, JP-A 62-56936 has proposed a gradational display scheme including sub-frames (modulation time units) for which reset pulses are applied at different timing (i.e., at different time instants), whereby 8 gradation levels are displayed in a time corresponding to 3 frames of the conventional binary display scheme (see FIG. 1B).

However, the above-mentioned scheme of displaying 8 gradation levels in a time of 3 frames requires a long reset period so that the average luminance at the brightest level is decreased by 40% from that in the binary display.

Examples of such a time modulation scheme (or frame thinning-out scheme or frame modulation scheme) are also disclosed in JP-A 64-61180, JP-A 5-127623 and EP-A 319291.

Anyway, in the above-mentioned time modulation scheme, one frame is constituted by scanning each scanning electrode the same number of times, so that it requires a long time for display and the frame frequency is lowered to cause flicker. If the number of scanning electrodes is decreased so as to prevent the occurrence of flicker, the resolution of a picture is lowered.

Further, as all the scanning electrodes are scanned the same number of times to constitute one frame, it is impossible to change the rewriting periodic time in case of changing the display, so that the display change cannot be effected quickly. More specifically, in operation of OA appliances, such as a computer and a work station, the intention of an operator should be quickly communicated to the CPU and reflected on the display, and the response of a moving display as by a pointing device, such as a mouse, should be accelerated.

SUMMARY OF THE INVENTION

An object of the present invention is to provide a display apparatus suitable for gradational display according to the time modulation scheme wherein each gradation level can be displayed in a short time and the average luminance at the brightest level is retained comparable to that according to a binary display scheme.

Another object of the present invention is to provide a display apparatus capable of a good halftone display while suppressing the flicker.

A further object of the present invention is to provide a display apparatus capable of displaying a moving display mark as by a pointing device, etc.

According to the present invention, there is provided a display apparatus comprising:

a display device comprising a pair of oppositely disposed substrates having thereon scanning electrodes and data electrodes, respectively, and an optical modulation substance disposed between the substrates so as to form a number of pixels each at an intersection of the scanning electrodes and the data electrodes, and drive means capable of setting one frame period to be divided into different periods of sub-frames, said drive means further including means for setting a whole picture scanning period for scanning all the scanning electrodes and a partial rewrite period for scanning only scanning electrodes for effecting a required display change so as to allow a partial rewrite in a shorter cycle than a frame cycle.

According to another aspect of the present invention, there is provided a data transmission apparatus, including:

a graphic controller for outputting data signals and a scanning scheme signal, a scanning signal control circuit for outputting scanning line address data and a scanning scheme signal, a data signal control circuit for outputting display data and a scanning scheme signal, and a display apparatus as described above.

According to still another aspect of the present invention, there is provided a display apparatus for gradational display according to a frame modulation scheme, comprising:

a display device comprising a plurality of scanning lines and a plurality of data lines so as to form a matrix of pixels each at an intersection of the scanning lines and the data lines, and drive means for:

(i) setting one frame including a plurality of sub-frame having different display periods, (ii) dividing said one frame into a plurality of equal blocks which are time-serially consecutive, (iii) dividing the scanning electrodes into a plurality of groups each including a plurality of adjacent scanning lines, and (iv) consecutively selecting scanning electrodes from each group of the adjacent scanning lines.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4 is an illustration of gradation data for respective pixels in one frame according to an embodiment of the invention.

FIGS. 5A–5C are conceptual illustrations of memories M1–M3 used in an embodiment of the invention.

DESCRIPTION OF THE PREFERRED EMBODIMENTS

First of all, a description will be made on a whole picture scanning mode adopted in driving an embodiment of the invention.

The embodiment is directed to a time modulation-type display apparatus which has an electrode matrix comprising scanning electrodes and data electrodes and is driven to effect a gradational display of one picture (frame) by plural times of scanning. In one picture scanning period, a substantially constant interval for applying a data signal waveform is allotted to all the data electrodes, different display periods are allotted to the respective scanning units, and the scanning units and the scanning electrodes are respectively discontinuously selected. The above-mentioned one picture-scanning period refers to a total period necessary for displaying one final picture, and the thus-formed one final picture is called one frame while each picture formed by each (scanning unit) of plural times of scanning for gradational display is called a sub-frame. In other words, one frame is displayed by scanning such a sub-frame a prescribed number of times (or effecting a prescribed number of sub-frame operations). The sub-frame may also be called a field.

Figure 1A:
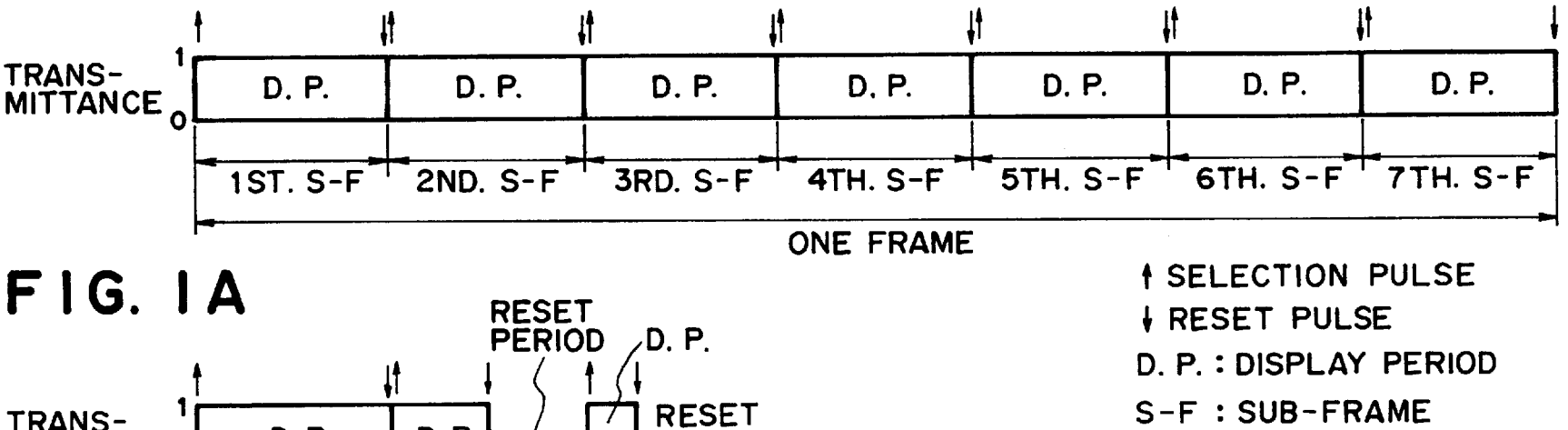
FIGS. 1A and 1B are respectively a time chart for illustrating a conventional modulation scheme.
Figure 1B:
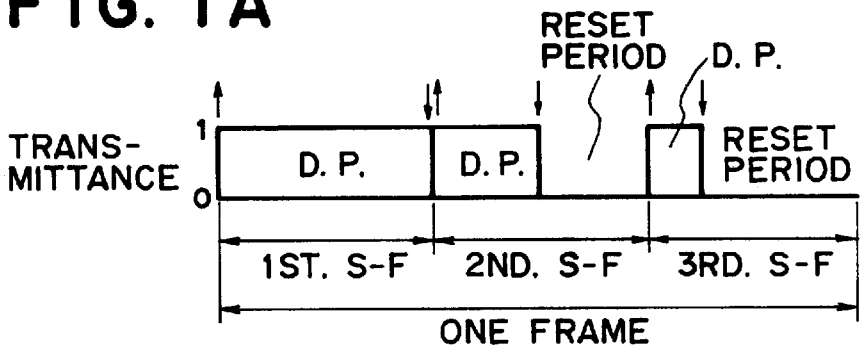
Figure 2:
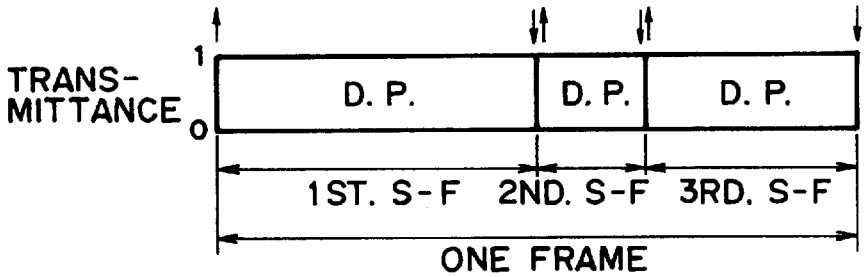
FIG. 2 is a time chart for illustrating a modulation scheme adopted in an embodiment of the display apparatus according to the invention.

FIG. 2 is a time chart for describing a modulation scheme used in this embodiment of the display apparatus. The modulation scheme shown in FIG. 2 is characterized by a shorter one-frame period when compared with the modulation scheme shown in FIG. 1A and by a characteristic of not lowering the luminance when compared with the scheme shown in FIG. 1B.

Figure 3:
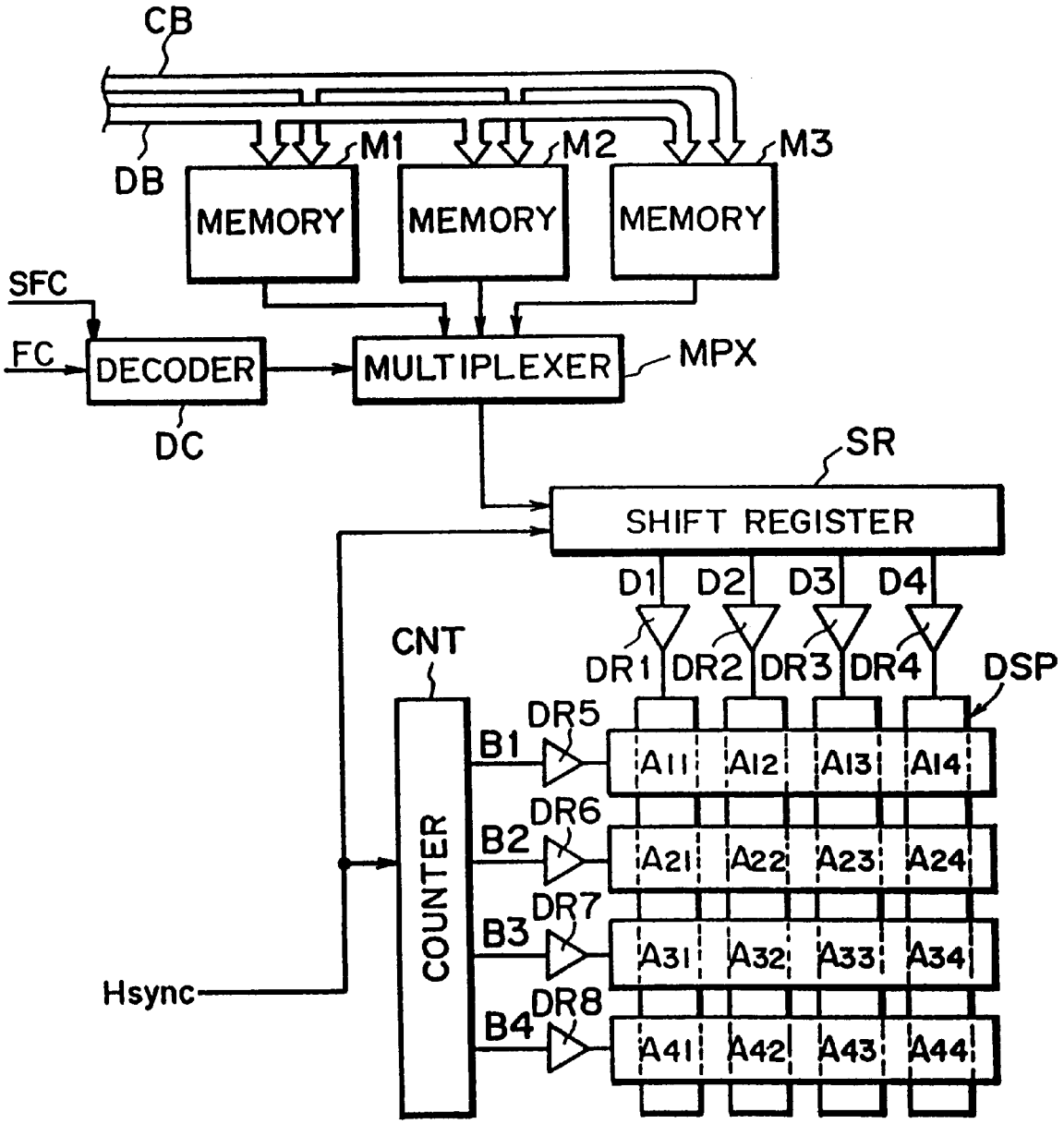
FIG. 3 is a drive circuit control diagram according to an embodiment of the invention.

FIG. 3 is a drive control circuit diagram.

Referring to FIG. 3, the circuit includes a display unit DSP comprising pixels $A_{11}$, $A_{12}$, . . . $A_{44}$, and frame memories M1, M2 and M3 each having a capacity of 4×4 (=16) bits. The memories M1–M3 are supplied with data from a data bus DB, and the address control of writing and readout are effected by a control bus CB.

A frame initiation signal FC and sub-frame hanging signals SFC are sent to a decoder DC and the decoded signals are sent to a multiplexer MPX, where one of the outputs from the memories M1–M3 is selected. A scanning clock signal Hsync is applied to a serial input- and parallel output shift register SR and a counter CNT which are respectively connected to data drive circuits DR1–DR4 and scanning drive circuits DR5–DR8 through lines D1–D4 and lines B1–B4 respectively.

FIG. 4 shows an example of gradation data for respective pixels in one frame. The respective gradation data are composed of an upper level bit, a medium level bit and a lower level bit which are inputted to memories M3, M2 and M1, respectively, through the data bus DB.

Figure 6:
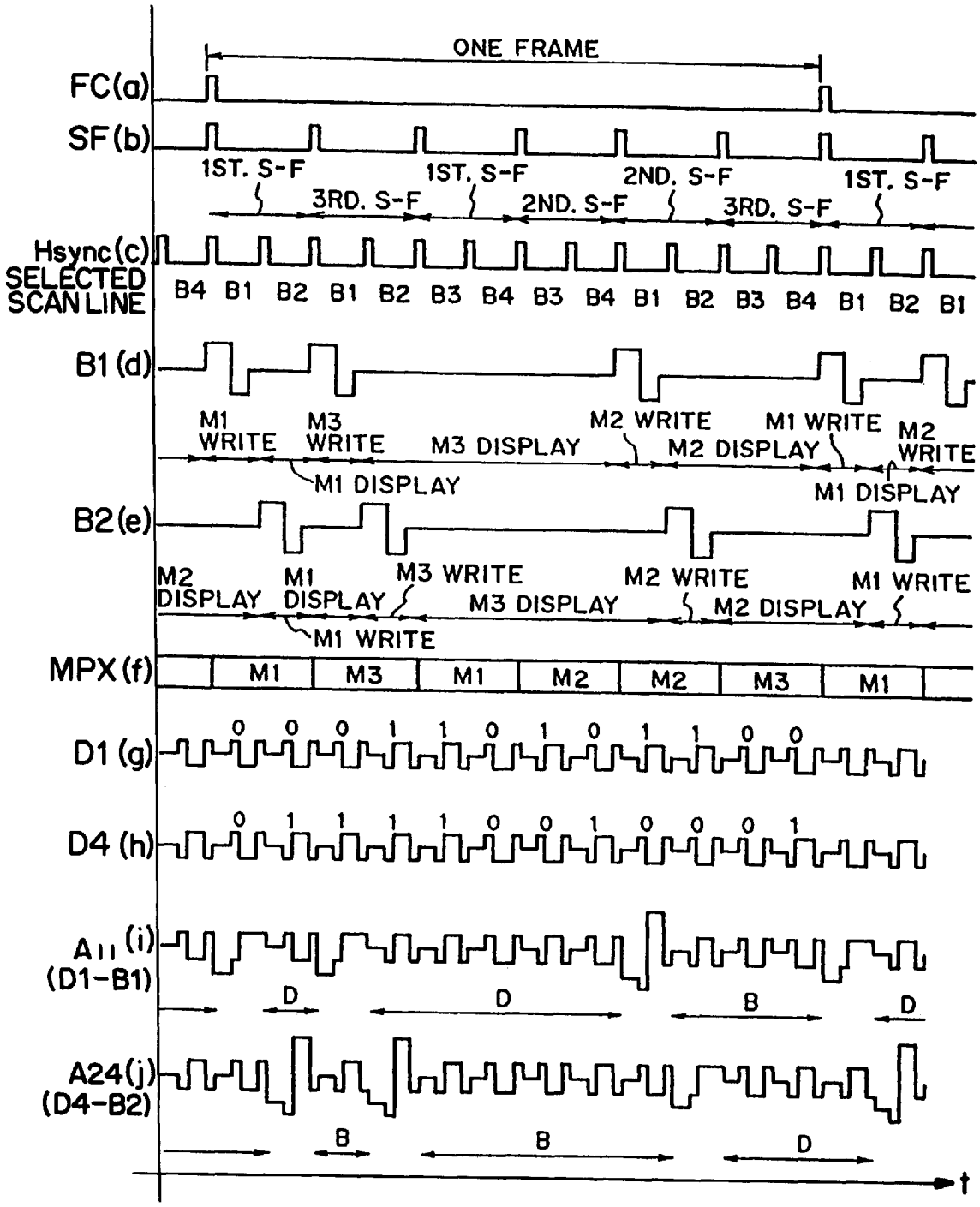
FIG. 6 is a drive time chart for the circuit shown in FIG. 3.

FIGS. 5A–5C are conceptual illustrations of the memories M1–M3, and FIG. 6 is a drive time chart for the circuit shown in FIG. 3.

A picture displaying the content of the memory M1 is called a first sub-frame, a picture displaying the content of the memory M2 is called a second sub-frame, and a picture displaying the content of the memory M3 is called a third sub-frame. Further, one frame scanning period is divided into 6 sub-periods which are sequentially allotted as scanning periods for the first, third, first, second, second and third sub-frames. In the first and third sub-frames, the scanning selection is performed in the order of DR5, DR6, DR7 and DR8 and, in the second sub-frame, the scanning selection is performed in the order of DR7, DR8, DR5 and DR6. In each of the 6 sub-periods formed by the 6-division, only two scanning lines are selected, so that each scanning electrode is selected in either a former half or a latter half of half-divided sub-frame. On a selected scanning line, writing is performed in a period of 1/12 of one frame scanning period and the resultant display state is retained until the same scanning line is scanned in a different sub-frame. As a result, the display periods of the respective sub-frames assume ratios of the first:second:third=1:3:5 for all the pixels $A_{11}$–$A_{44}$ and, according to a selection of combination of the sub-frames, 8 types of periods including 0/9, 1/9, 3/9, 4/9, 5/9, 6/9, 8/9 and 9/9 can be selected, so that 8 gradational displays can be displayed according to the time modulation.

Figures 7, 8:
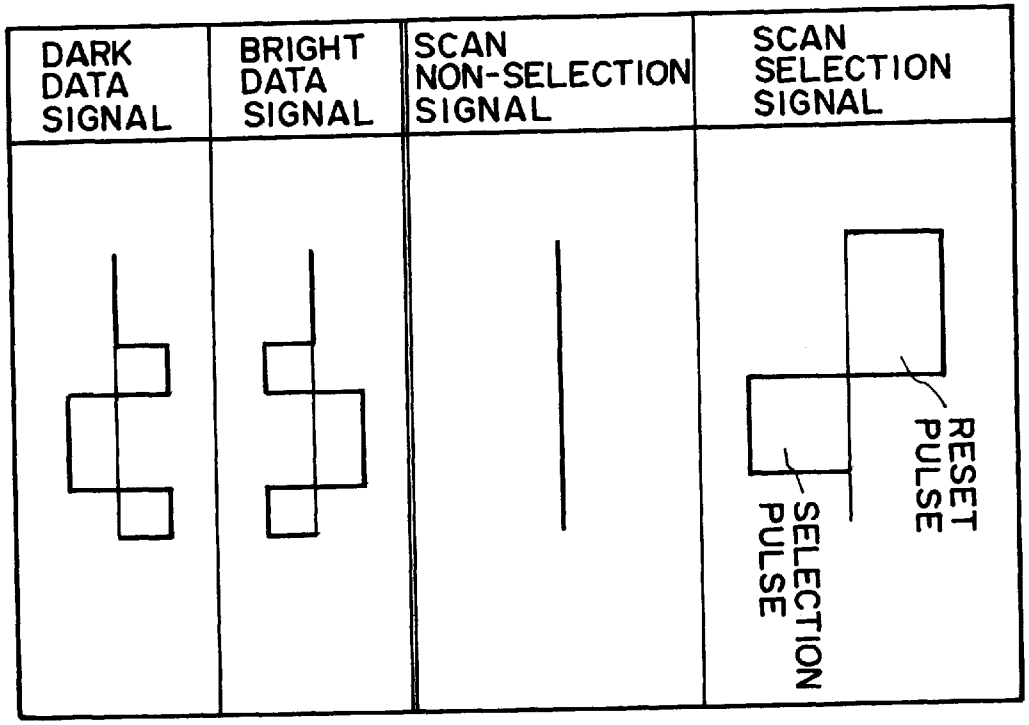
FIG. 7 is an illustration of gradational display states of respective pixels according to the gradation data shown in Table 4.
FIG. 8 is a waveform diagram for illustrating a set of drive signals used in the circuit shown in FIG. 3.

The gradations at the respective pixels having the gradation data shown in FIGS. 4 and 5 are shown in FIG. 7. The numerical values shown in FIG. 7 correspond to the periodical proportion of bright display in one frame-scanning period. Accordingly, the darkest display level corresponds to 0 (=0/9) and the bright display level corresponds to 1 (=9/9). FIG. 8 shows a set of drive signal waveforms used in the above-described type of display including a scanning selection signal waveform which is composed of a reset pulse for resetting a pixel to the dark state and a selection pulse for selecting either the bright or dark state for the pixel. Hereinbelow, the operation of the circuit shown in FIG. 3 will be described.

When a frame initiation signal FC is generated, the data in the memories M1–M3 are rewritten by the control bus and the data bus. Then, a sub-frame changing signal SFC is generated, and the multiplexer MPX is set by the decoder DC to select data from the memory M1.

In synchronism with a scanning clock signal Hsync, the counter CNT causes the driver DR5 to supply a scanning selection signal to a line B1. At this time, the shift register SR is supplied with first row data in the memory M1 so that the drivers DR1, DR2 and DR4 supply a dark state signal waveform and the driver DR3 supplies a bright state signal waveform. As a result, only the pixel $A_{13}$ is placed in the bright state and the pixels $A_{11}$, $A_{12}$ and $A_{14}$ are placed in the dark state. Then, in synchronism with a subsequent scanning clock signal Hsync, the counter CNT supplies a scanning selection signal waveform to the driver DR6, when the shift register SR is inputted with second row data in the memory M1.

Then, when a sub-frame changing signal SFC is generated, the decoder DC sets the multiplexer MPX to select data from the memory M3. Thereafter, similarly as described above, a scanning selection signal and data signals are outputted in synchronism with a row scanning signal F. The order of selecting sub-frames and the order of scanning selection in a sub-frame are performed according to data preliminarily set in a separate memory region (not shown). The data set in such a memory in this embodiment are as shown in Tables 1 and 2 shown below.

TABLE 1

Sub-frame selection order

| | Sub-frame (frame memory) |
|---|---|
| 1 | 1 (M1) |
| 2 | 3 (M3) |
| 3 | 1 (M1) |
| 4 | 2 (M2) |
| 5 | 2 (M2) |
| 6 | 3 (M3) |

TABLE 2

Scanning selection order in a sub-frame

| | 1st sub-frame | 2nd sub-frame | 3rd sub-frame |
|---|---|---|---|
| 1 | B1 | B3 | B1 |
| 2 | B2 | B4 | B2 |
| 3 | B3 | B1 | B3 |
| 4 | B4 | B2 | B4 |

After completion of one frame operation, a frame initiation signal is again generated, the data in the memories are rewritten into data for a subsequent frame.

Incidentally, instead of using the sub-frame-changing signal, it is also possible to change both the sub-frame and scanning address in synchronism with the scanning clock signal Hsync. In this instance, data as shown in Table 3 below are set in a memory region in advance.

TABLE 3

Sub-frame and scanning address selection order

| | Sub-frame (frame memory) | Scanning address |
|---|---|---|
| 1 | 1 (M1) | B1 |
| 2 | 1 (M1) | B2 |
| 3 | 3 (M3) | B1 |
| 4 | 3 (M3) | B2 |
| 5 | 1 (M1) | B3 |
| 6 | 1 (M1) | B4 |
| 7 | 2 (M2) | B3 |
| 8 | 2 (M2) | B4 |
| 9 | 2 (M2) | B1 |
| 10 | 2 (M2) | B2 |
| 11 | 3 (M3) | B3 |
| 12 | 3 (M3) | B4 |

According to the above-described gradation drive scheme, it is possible to display the same number of gradations in a shorter period and at a higher luminance compared with conventional gradational display scheme. A comparison is given in the following Tables 4 and 5 and in FIG. 2 (in comparison with FIGS. 1A and 1B) with the level of the binary display as the standard of comparison.

TABLE 4

Comparison with conventional scheme (8 gradation display)

| | Time | Brightest luminance |
|---|---|---|
| Invention | 3 frames | 100% |
| Conventional scheme 1 | 7 frames | 100% |

TABLE 4-continued

| | Comparison with conventional scheme (8 gradation display) | |
|---|---|---|
| | Time | Brightest luminance |
| Conventional scheme 2 | 3 frames | 58% |

TABLE 5

| | Comparison with conventional scheme ($2^n$ gradation display) | |
|---|---|---|
| | Time | Brightest luminance |
| Invention | n frames | 100% |
| Conventional scheme 1 | $2^n - 1$ frames | 100% |
| Conventional scheme 2 | n frames | $(2/n) \cdot (1 - 1/2^n)\%$ |

Next, a display device suitably used in the present invention and a partial rewrite scanning operation to b e combined with the above-mentioned modulation scheme will now be described.

Figure 9:
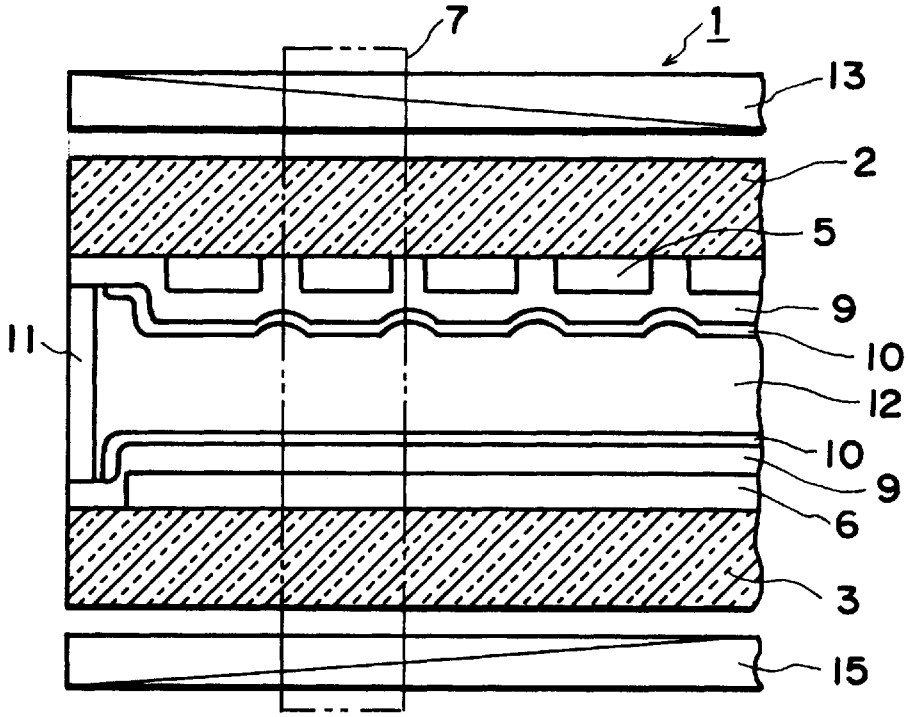
FIGS. 9 and 10 are a sectional view and a plan view, respectively, of a liquid crystal display device used in an embodiment of the invention.

Referring to FIG. 9, a display device 1 includes a pair of oppositely disposed glass substrates 2 and 3 with a prescribed gap therebetween. The substrates 2 and 3 have thereon scanning electrodes 5 and data electrodes 6, respectively, in a large number. The electrodes 5 and 6 are respectively in the form of a stripe as shown in FIG. 6 and form a large number of pixels 7 at their intersections. The electrodes 5 and 6 may be respectively coated, as desired, with an insulating film 9 and further with an alignment film 10. The peripheral gap between the substrates is sealed with a sealing member 11 to leave a spacing between the substrates, which spacing is filled with an optical modulation substance 12. Further, outside the substrates 2 and 3 are optionally disposed oppositely an analyzer 13 and a polarizer 15, which may be disposed in cross nicols.

The optical modulation substance 12 may for example comprise a liquid crystal material, an electrochromic substance, etc. It is particularly preferred to use a chiral smectic liquid crystal inclusive of a ferroelectric liquid crystal and an anti-ferroelectric liquid crystal.

The optical modulation substance 12 may suitably have a bistability with respect to an electric field, i.e., a property of assuming either a first optically stable state (e.g., constituting a bright state) or a second optically stable state (e.g., constituting a dark state) in response to an electric field applied thereto.

In the present invention, it is particularly preferred to use a liquid crystal having a bistability, most suitably a chiral smectic liquid crystal having a ferroelectricity in its chiral smectic C phase (SmC*), H phase (SmH*), I phase (SmI*), F phase (SmF*), or G phase (SmG*). Such a ferroelectric liquid crystal has been described, e.g., in LE JOURNAL DE PHYSIQUE LETTERS, 36 (L-69), 1975, "Ferroelectric Liquid Crystals"; Applied Physics Letters 36 (11), 1980, "Submicro-Second Bistable Electrooptic Switching in Liquid Crystals"; and Solid State Physics (Kotai Butsuri), 16 (141), 1981 "Liquid Crystals (Ekisho)". In the present invention, ferroelectric liquid crystals disclosed in these references can be used.

Specific examples of such a ferroelectric liquid crystal may include decycloxybenzylidene-p'-amino-2-methylbutyl-cinnamate (DOBAMBC), hexyloxybenzylidene-p'-amino-2-chloropropyl-cinnamate (HOBACPC) and 4-o-(2-methyl)-butylresorcilidene-4'-octylaniline (MBRA 8). When a device is constituted by using these materials, the device may be supported, if necessary, with a block of copper, etc., in which a heater is embedded, so as to provide a temperature where such a liquid crystal compound assumes SmC*, SmH*, SmI*, SmF* or SmG*. The basic operation principle of a ferroelectric liquid crystal device will be described later.

A ferroelectric liquid crystal device suitably used as a display device in the present invention will now be described. Hitherto, there has been well known a type of liquid crystal display device comprising an electrode matrix composed of scanning electrodes and data electrodes and a liquid crystal disposed between the scanning electrodes and data electrodes so as to form a large number of pixels each at an intersection of the scanning electrodes and data electrodes. Among these, a ferroelectric liquid crystal device having a bistability and showing a quick response to an electric field has been expected as a display device of a high speed and memory type. For example, JP-A 61-9023 discloses a liquid crystal display device including two glass substrates each having transparent electrodes thereon and subjected to an aligning treatment which are disposed opposite to each other with a gap of 1–3 $\mu$m, and a ferroelectric liquid crystal injected between the glass substrates. Also many proposals have been made regarding matrix drive methods for such a ferroelectric liquid crystal device. For example, practical drive apparatus are disclosed in U.S. Pat. Nos. 4,655,561, 4,709,995, 4,800,382, 4,836,656, 4,923,759, 4,938,754 and 5,058,994.

Figure 11:
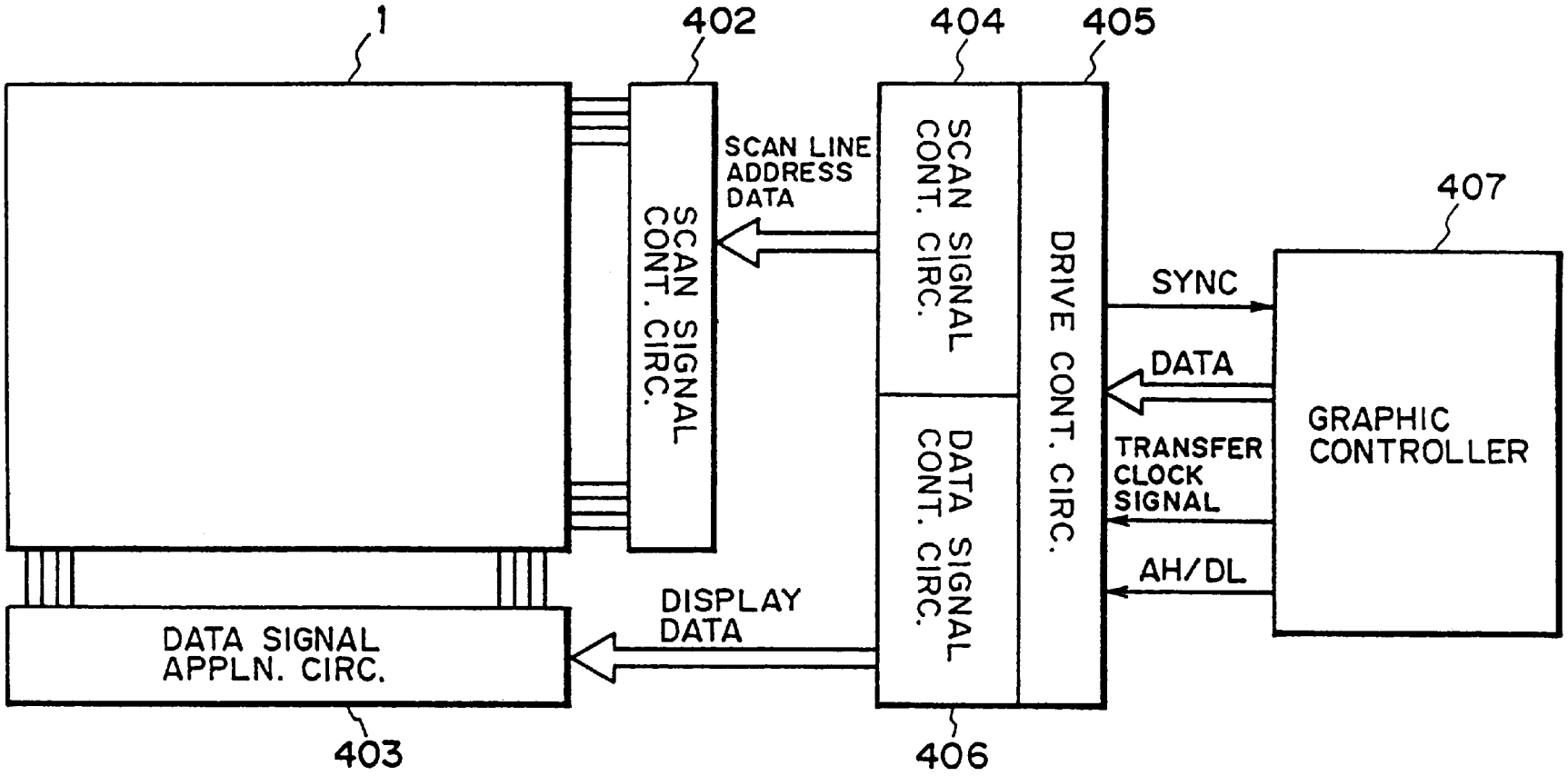
FIG. 11 is a block diagram for illustrating peripheral appliances surrounding a liquid crystal display device.

A display device as described above may be used by incorporating it into a display control device as shown in FIG. 11. Referring to FIG. 11, a liquid crystal display device 1 is connected to a scanning signal application circuit 402 and a data signal application circuit 403, which in turn are connected to a scanning signal control circuit 404 and a data signal control circuit 406, respectively, and further sequentially connected to a drive control circuit 405 and a graphic controller 407. Further, scanning scheme signals and data are supplied to the scanning signal control circuit 404 and the data signal control circuit 406 from the graphic controller 407 via the drive control circuit 405. The data are converted into address data and display data by the circuits 404 and 406, and the scanning scheme signals are supplied as they are to the scanning signal application circuit 402 and the data signal application circuit 403. Further, the scanning signal application circuit 402 generates a scanning signal A (FIG. 12) based on the address data, and the signal A is applied to the scanning electrodes 5. Further, the data signal application circuit 403 generates data signals B and C and supply either one of the data signals B and C to the respective data electrodes 6.

Figure 12:
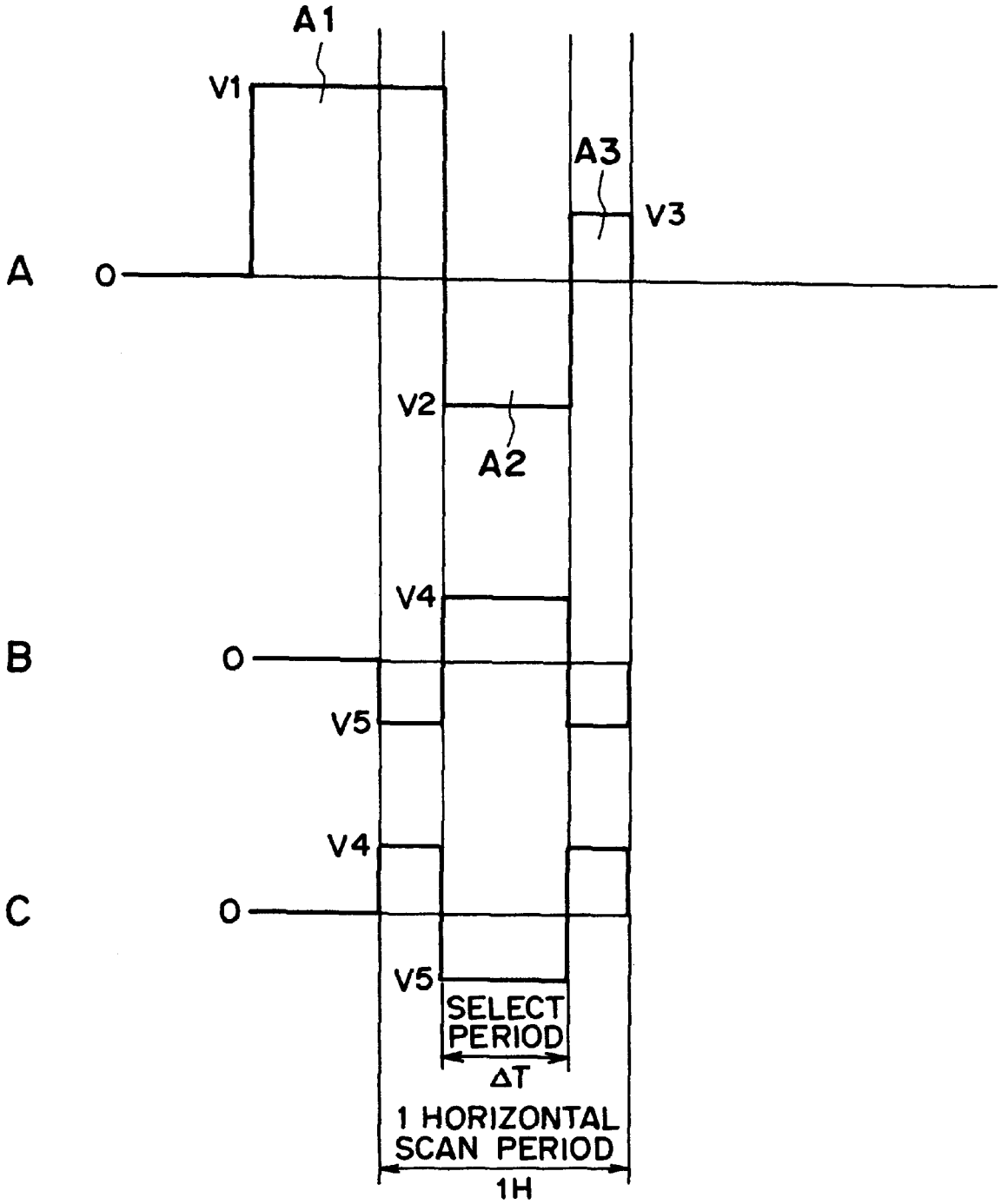
FIG. 12 is a waveform diagram for illustrating a scanning signal A and data signals B and C.

Then, the signals A, B and C will be described based on FIG. 12.

Figure 13:
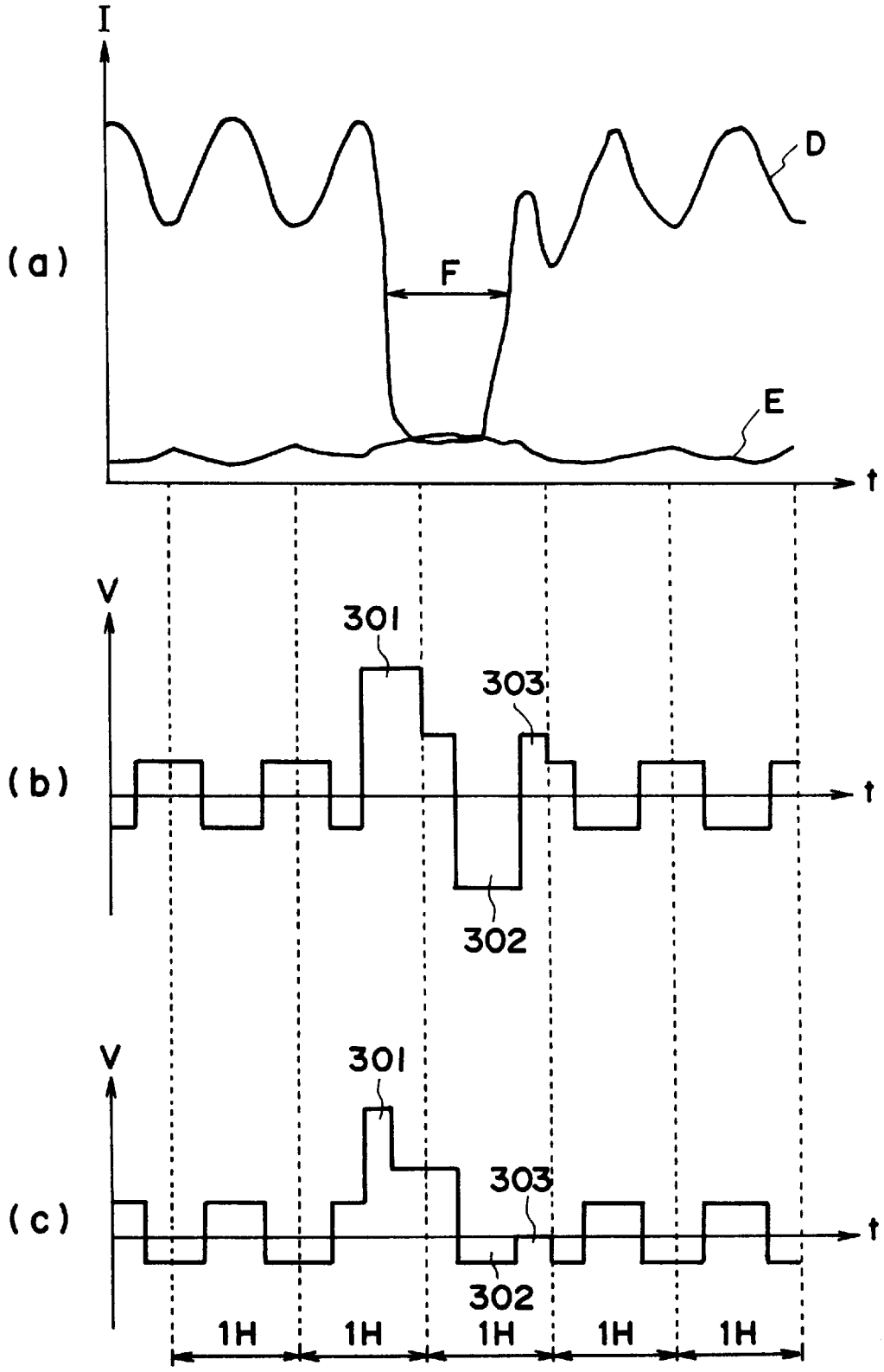
FIG. 13 shows waveforms including curves of transmittance changes at pixels at (a) and drive signal waveforms (b) and (c) giving the changes at (a).

The scanning signal A is composed of a reset pulse A1, a selection pulse A2 and an auxiliary pulse A3. The data signal B is a bright data signal, and the other data signal C is a dark data signal. The reset pulse A1 has an amplitude V1, the selection pulse A2 has an amplitude V2, the auxiliary pulse A3 has an amplitude V3, and the data signals B and C include pulses having amplitudes V4 and V5. The reset pulse A1 of the scanning signal A has a function of resetting all the pixels or a selected scanning electrode into the dark state, and these pixels are caused to have a sequence of states including data display (bright display or dark display)→resetting (into the dark state)→data display (bright display or dark display). Waveform (a) of FIG. 13 shows an example of such sequential display states including a curve D representing a sequence of bright display→dark state→bright display and a curve E representing a sequence of dark display→dark state→dark display. In waveform (a), the abscissa represents time and the ordinate represents a transmitted light quantity.

Incidentally, a display in a strict sense is not effected in a period denoted by a symbol F in waveform (a), i.e., a part of the reset period plus a part of the selection period, and an actual display period is given by excluding the period F. However, in case where a period from one scanning selection to a subsequent scanning selection is sufficiently long compared with the reset period, the period may be regarded as a display period without a substantial problem. In the case of using the signals shown in FIG. 12, the period F is almost equal to one horizontal scanning period 1H. Incidentally, waveform (b) in FIG. 13 shows a voltage waveform applied to a pixel in order to have the pixel exhibit a state change of the curve D, and waveform (a) FIG. 13, a state change of the curve E. Further, the pulses 301, 302 and 303 are a reset pulse, a selection pulse and an auxiliary pulse, respectively, and correspond to pulses obtained by combination of the scanning signal and the data signals shown in FIG. 12.

Next, the timing of scanning selection for driving a liquid crystal display device having 320×200 pixels (320 data lines×200 scanning lines), for example, will be described with reference to FIG. 14 wherein the ordinate (y-axis) represents an address of the scanning electrode and the abscissa (x-axis) represents time with one vertical scanning period (100 H) as a unit.

In this embodiment, one frame includes 600 H for 600 times of scanning selection and one frame is divided into 6 blocks of first to sixth blocks, so that four blocks of the 1st, 3rd, 4th and 6th blocks are used to constitute a whole picture scanning period and the remaining two blocks of the 2nd and 4th blocks are used to constitute a partial rewrite scanning period. Accordingly, 400 times (400 H) of whole picture scanning are performed in the whole picture scanning period, and 200 times (200 H) of partial rewrite scanning are performed in the partial picture scanning period In the embodiment of FIG. 14, the whole picture scanning is performed by a frame modulation scheme similar to the one adopted in an embodiment of FIG. 36 described hereinafter so that the latitude of setting the partial rewrite period is increased Accordingly, an appropriate period can be selected depending on the size of a partial rewrite region and the frequency of partial rewriting More specifically, in the embodiment of FIG. 14, a partial rewrite period is placed after the scanning selection of the 1st block and the 4th block, respectively, so that the weight of the frame modulation should be identical in the upper portion and the lower portion.

Figure 14:
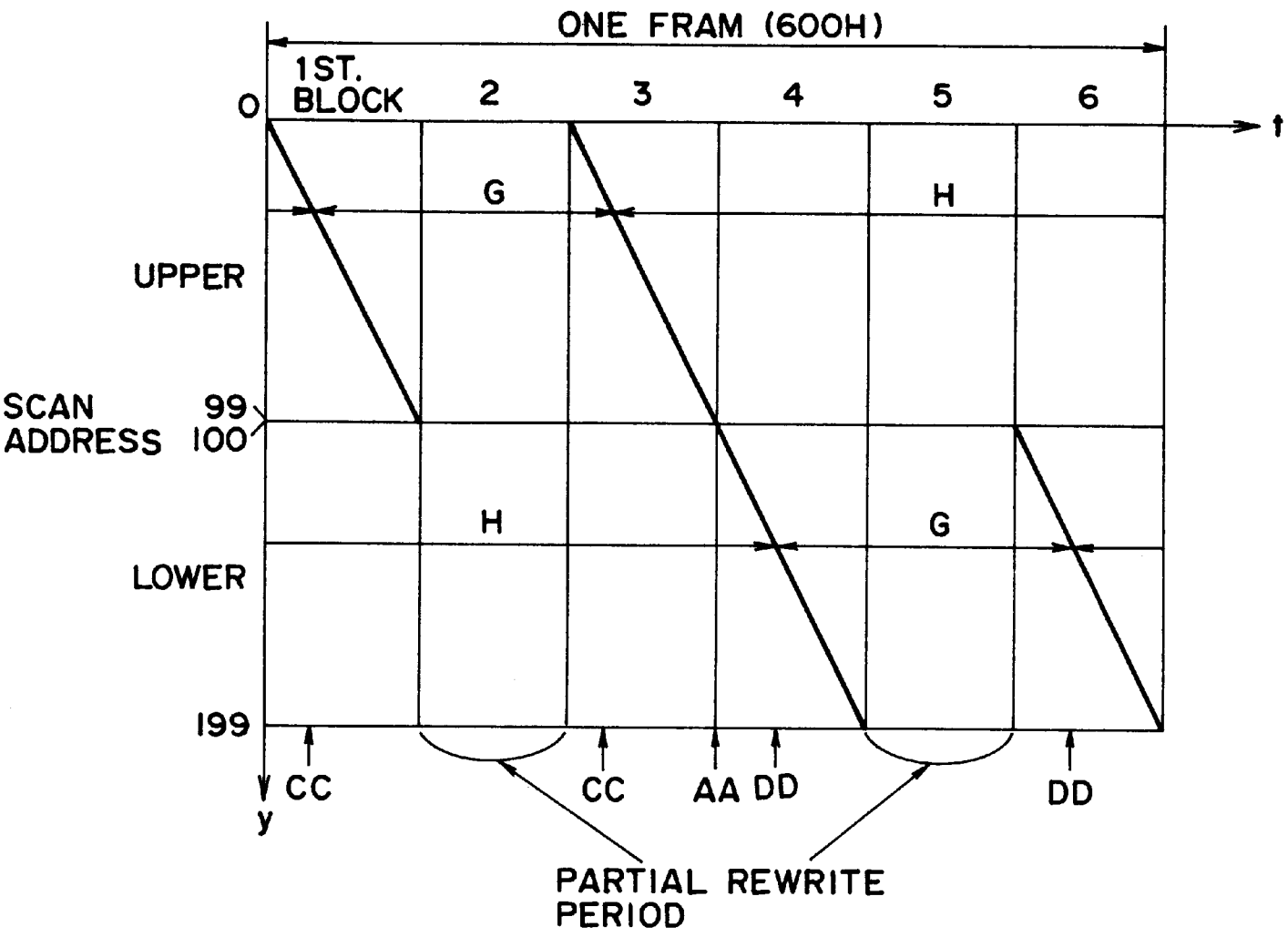
FIG. 14 is a chart for illustrating a relationship between the scanning address and the scanning signal application timing.

As another embodiment, it is also possible to place a partial rewrite period at a part denoted by an arrow AA, i.e., only between the 3rd and 4th blocks, instead of placing such a partial rewrite period twice, i.e., between the 1st and 3rd blocks and between the 4th and 6th blocks as in the embodiment of FIG. 14. Alternatively, it is also possible to insert such a partial rewrite period at four parts indicated by arrows CC and DD. Further, it is also possible to place two partial rewrite periods at parts of arrows CC and also one partial rewrite period in the 5th blocks. Further, it is also possible to place two partial rewrite periods at the parts of arrows DD and one partial rewrite period in the 2nd block.

The parts of two arrows CC (or two arrows DD) correspond to the selection time of an identical scanning electrode in the respective blocks to which the arrows belong.

The partial rewrite can be performed according to a binary write scheme but may preferably be performed by a frame modulation scheme so as not to cause a contrast difference between the case of partial rewrite and the case of no partial rewrite.

In this case, the frame frequency may preferably be at least 20 Hz.

The partial rewrite frequency may preferably be at least 60 Hz.

Further, in the whole picture scanning period, it is preferred to effect a $2^n$ gradation display (n: a positive integer).

Further, in the partial rewrite period, it is preferred to effect a $2^n$ gradation display (n: a positive integer).

It is further preferred to effect a display of identical gradations in both the whole picture scanning period and the partial rewrite period.

Further, it is preferred to effect interlaced scanning in the whole picture scanning period.

It is further preferred to use a ferroelectric liquid crystal as the liquid crystal.

On the other hand, in the present invention, it is preferred to constitute a data transmission apparatus with a graphic controller for outputting data signals and scanning scheme signals, a scanning signal control circuit for outputting scanning line address data and a scanning scheme signal and a data signal control circuit for outputting display data and a scanning scheme signal.

Hereinbelow, the whole picture scanning period and the partial rewrite scanning period of FIG. 14 will be described in further detail.

Figure 15:
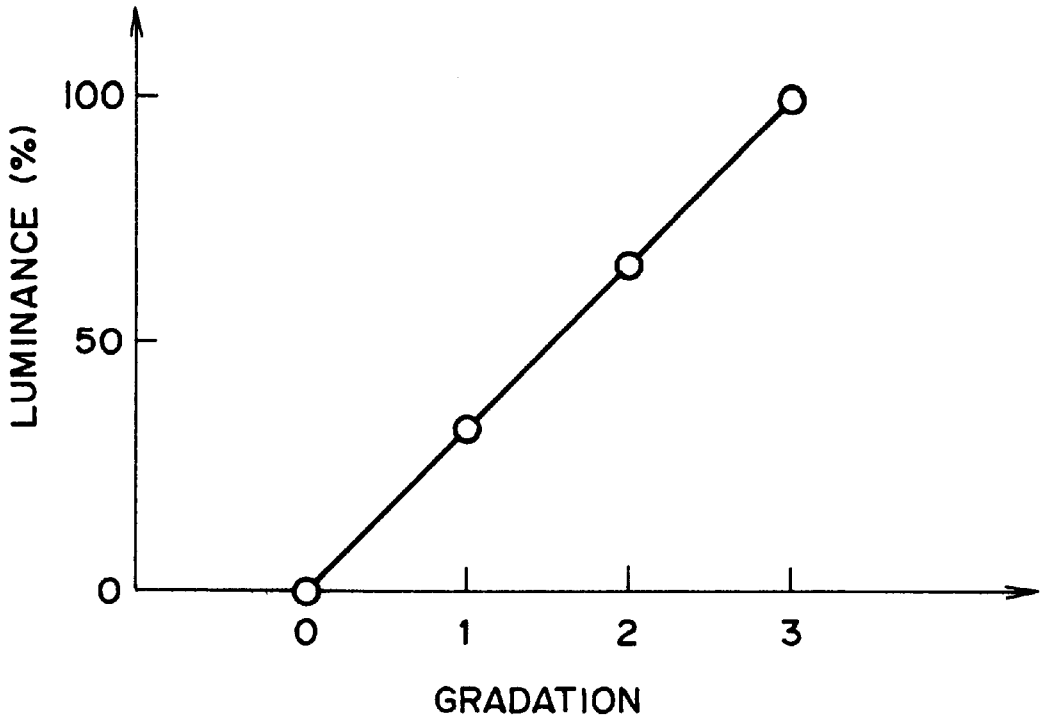
FIGS. 15 and 17 are respectively a chart illustrating a relationship between a gradation and a luminance at a pixel.
Figure 17:
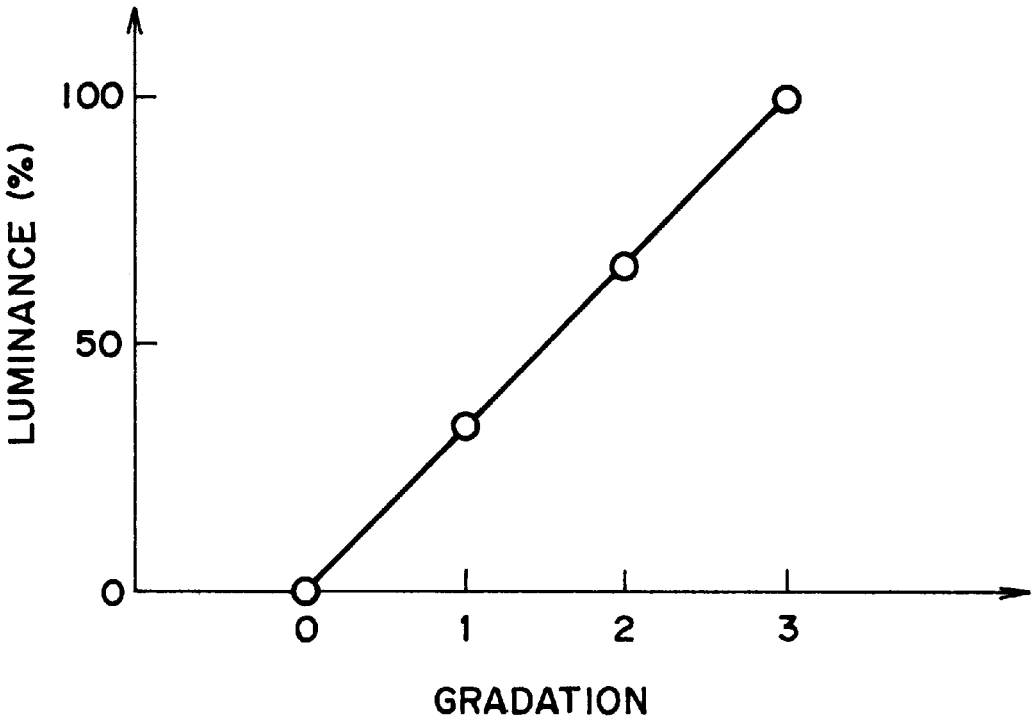

In the whole picture scanning period, 200 scanning addresses are scanned two times each to effect a total of 400 times regardless of whether the display data are changed or not. More specifically, in case where the scanning addresses are divided into an upper half including 0–99 and a lower half including 100–199, the upper half is first scanned in the 1st block and scanned the second time in the 3rd block, and the lower half is first scanned in the 4th block and scanned the second time in the 6th block. By effecting the scanning according to such a schedule, all the scanning addresses (i.e., scanning lines) are caused to have an identical ratio between periods G and H (i.e., a sub-frame ratio) of 1:2. Accordingly, by combining the periods G and H for dark display/bright display as shown in the following Table 6, four gradations can be displayed, whereby luminance levels as shown in FIG. 15 can be displayed with a relative scale of 100% for the bright display and 0% for the dark display. Incidentally, in order to strictly calculate the ratio between the display periods G and H, it is necessary to consider the reset period. However, the reset period amounts to only 1/200 or 1/400 of the total period (from a certain scanning selection to a subsequent scanning selection).

TABLE 6

| | Display period | |
|---|---|---|
| Gradation | G | H |
| 0 | dark | dark |
| 1 | bright | dark |
| 2 | dark | bright |
| 3 | bright | bright |

In the partial rewrite scanning period of the embodiment of FIG. 14, 200 times of scanning selection are performed in two blocks by performing 100 times of scanning selection in each block, and each block is further divided into 5 sets each including 20 times of scanning selection.

Figure 16:
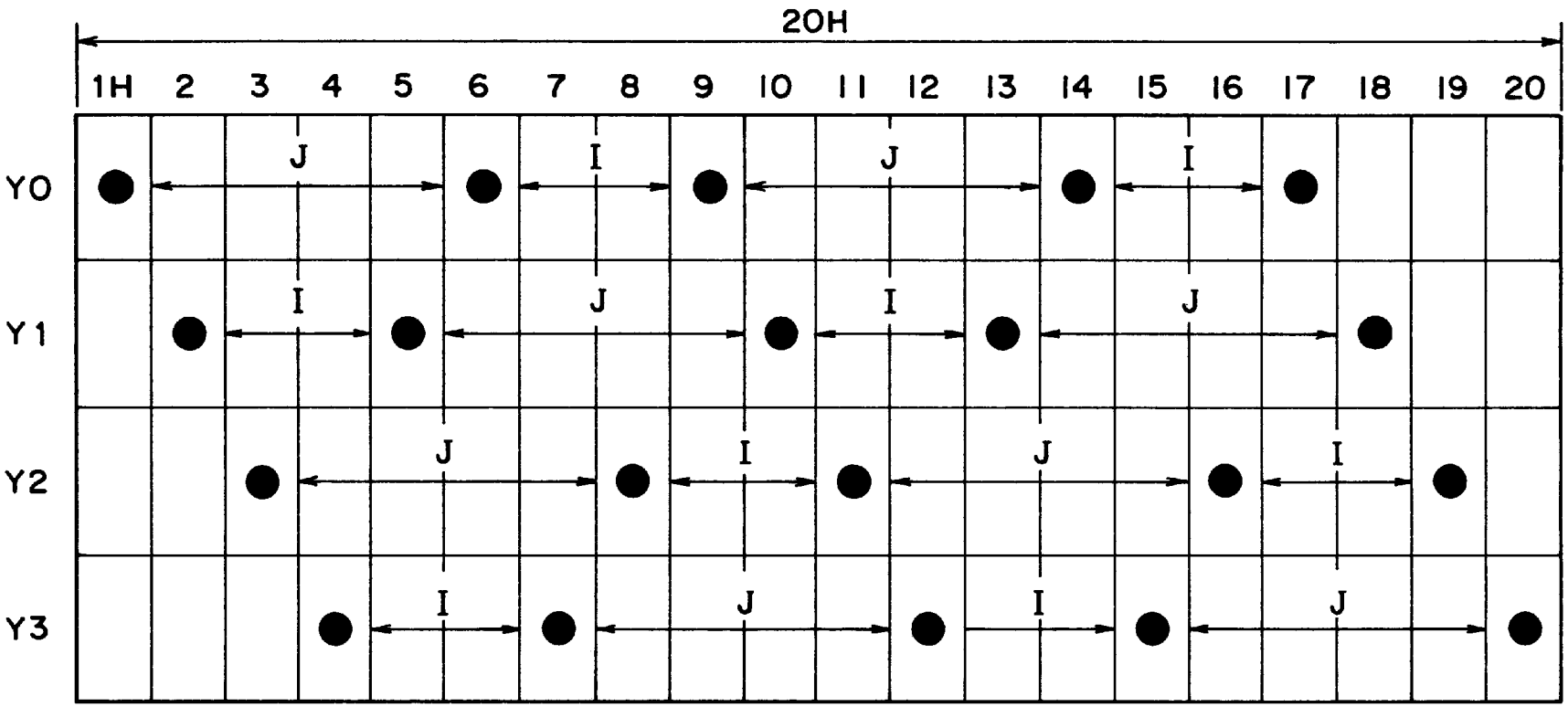
FIG. 16 is a chart for illustrating a set of operations including 20 times of scan selection for 4 scanning addresses Y0–Y3.

In each set, four scanning addresses including a display change are arbitrarily selected to effect 20 times of scanning selection. Accordingly, in one block, 20 scanning lines (addresses) are partially rewritten FIG. 16 shows the timing of 20 times of scanning selection for 4 scanning lines Y0–Y3 in one set. In FIG. 16, ● represents a dark state period caused by scanning selection. For each scanning address, display periods I and J having a duration ratio of 1:2 are provided twice each so as to provide a clear gradation. By setting the ratio between the display periods I and J to 1:2, four gradations can be displayed by the combination of the periods I and J for dark/bright display as shown in Table 7 below.

TABLE 7

| | Display period | |
|---|---|---|
| Gradation | I | J |
| 0 | dark | dark |
| 1 | bright | dark |
| 2 | dark | bright |
| 3 | bright | bright |

In the embodiment of FIG. 14, four gradations are displayed in both the whole picture scanning and the partial rewrite scanning so as to retain the same gradation and luminance, so that an operator can easily recognize the gradation level under display and the occurrence of flicker due to a difference in gradation can be suppressed.

In the embodiment of FIG. 14, two blocks of the 2nd and 5th blocks are used as the partial rewrite scanning period, and the whole picture scanning period and the partial rewrite scanning period are alternately placed. Accordingly, compared with the case where the partial rewriting is performed by stopping the whole picture scanning in order to effect a display change, the decrease in display quality can be suppressed and a good halftone display can be effected Further, as the partial rewrite scanning period is evenly disposed in one frame, it is possible to provide an improved response to a display change.

Further, by setting the frame modulation ratio(s) to $2^n$ (n: a positive integer), the image quality is kept good and the data processing is facilitated.

Further, in the embodiment of FIG. 14, the partial rewrite operation is effected at a higher frequency than in the driving method including the whole picture scanning as the normal mode of display, the response of a moving display as by a pointing device can be improved. Further, as an appropriate balance is provided between the whole picture scanning period and the partial rewrite scanning period without placing a gap between successive scanning selections, it is possible to obviate a delay in scanning cycle period and also the lowering in frame frequency or the occurrence of flicker.

Figure 18:
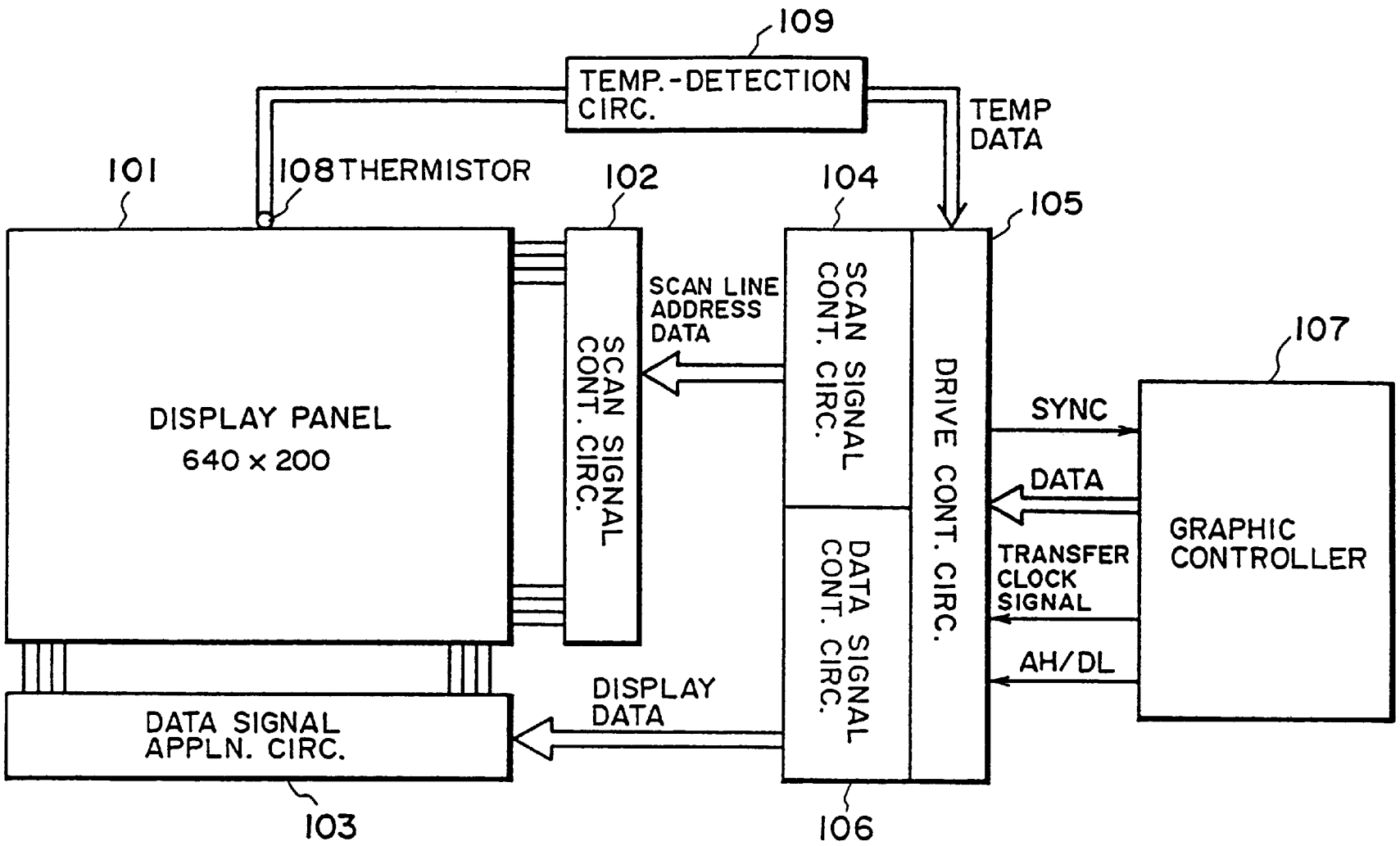
FIG. 18 is a block diagram for illustrating another embodiment of the invention
Figure 19:
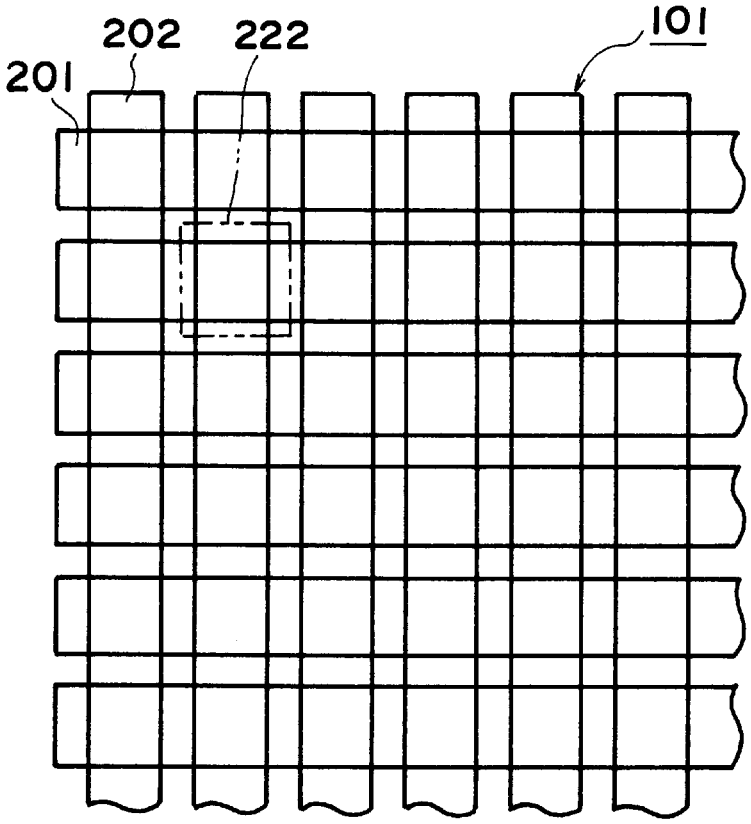
FIG. 19 is an enlarged view of the display unit (panel) in the embodiment.

FIG. 18 shows another display control system used in the present invention. The display apparatus in the system includes a display unit (panel) 101 having an electrode matrix constituted by scanning electrodes 201 and data electrodes 202 as shown in FIG. 19, a data signal application circuit 103 for applying data signal to an optical modulation substance disposed between the scanning electrodes and the data electrodes via the data electrodes 202, a scanning signal application circuit 102 for applying a scanning signal to the optical mediation substance via the scanning electrodes 201, a scanning signal control circuit 104, a data signal control circuit 106, a drive control circuit 105, a thermistor 108 for detecting the temperature of the display unit 101, and a temperature detection circuit for detecting the temperature of the display unit 101 based on the output of the thermistor 108. The optical modulation substance disposed between the scanning electrodes 201 and the data electrodes 202 may for example comprise a liquid crystal. The system further includes a graphic controller 107, and data sent from the graphic controller 107 are sent via the drive control circuit 105 and inputted to the scanning signal control circuit 104 and the data signal control circuit 106 to be converted into address data and display data. The temperature of the display unit is inputted to the temperature detection circuit 109 via the thermistor 108, and temperature data therefrom are inputted to the scanning signal application circuit 104 via the drive control circuit 105. Then, scanning signals are generated by the scanning signal application circuit 102 and supplied to the scanning electrodes 201 of the display unit 101 based on the address data and the temperature data. On the other hand, data signals are generated by the data signal application circuit 103 based on the display data and supplied to the data electrodes 202 of the display unit 101.

Figure 10:
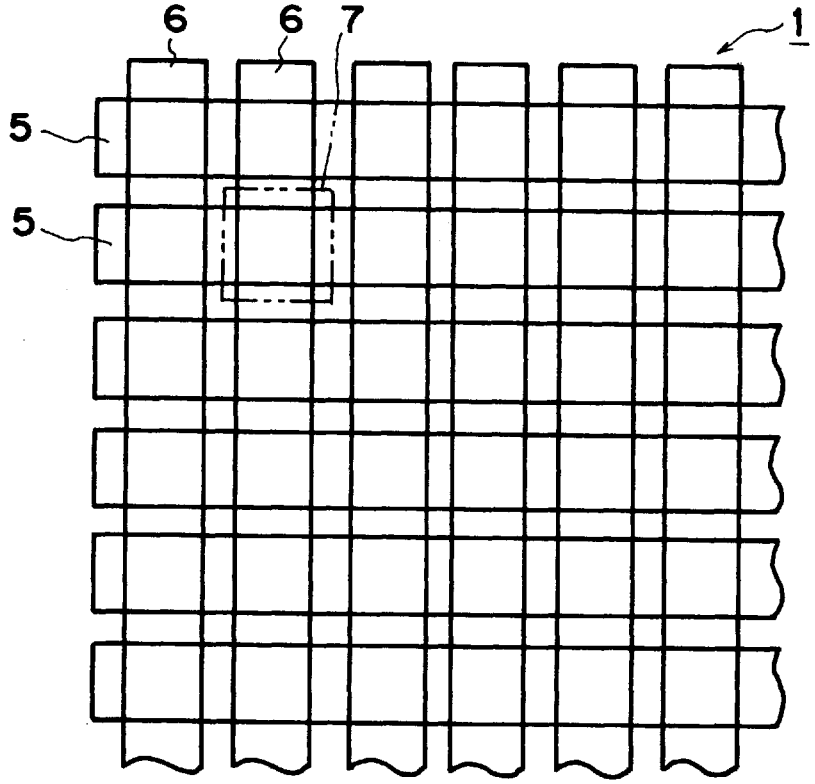

FIG. 19 shows an electrode matrix constituted by the scanning electrodes 201 and the data electrodes 202 so as to form a pixel 222 at each intersection of the scanning electrodes and the data electrodes. In this embodiment, 200 scanning electrodes 201 and 640 data electrodes are used to constitute 640×400 pixels arranged in a matrix. The structure is basically identical to the one described with reference to FIG. 10.

Figure 20:
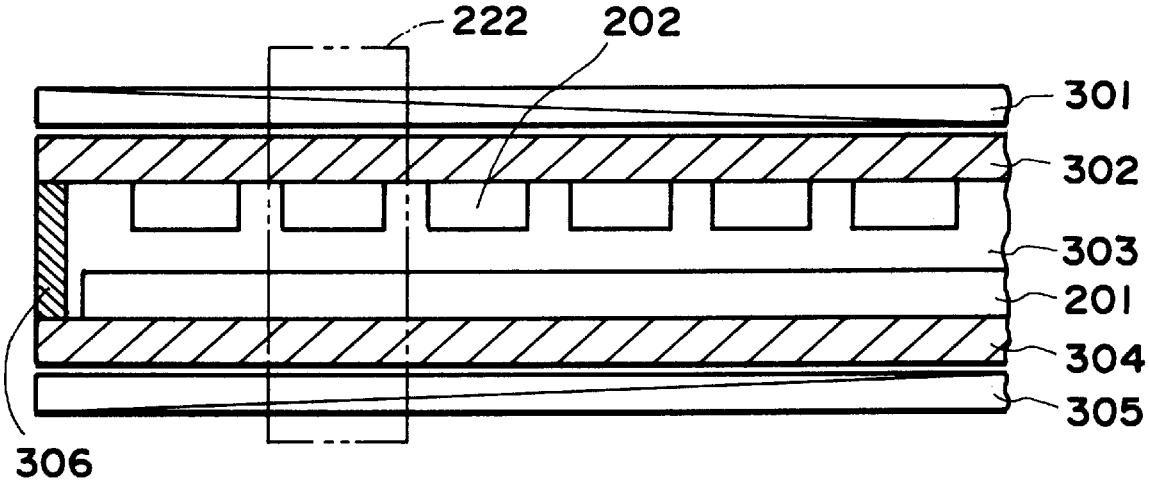
FIG. 20 is a sectional view of the display panel shown in FIG. 19.

FIG. 20 shows a partial sectional structure of the display unit 101. The display unit (panel) includes an analyzer 301 and a polarizer 305 disposed so as to sandwich a cell structure including glass substrates 302 and 304 having thereon transparent electrodes 202 and 201 and sandwiching an optical modulation substance 303 with a sealant 306 disposed at the periphery. The structure is basically identical to the one described with reference to FIG. 9.

Now, the basic operation principle of a ferroelectric liquid crystal as a preferred example of the optical modulation substance will be described.

Figure 21:
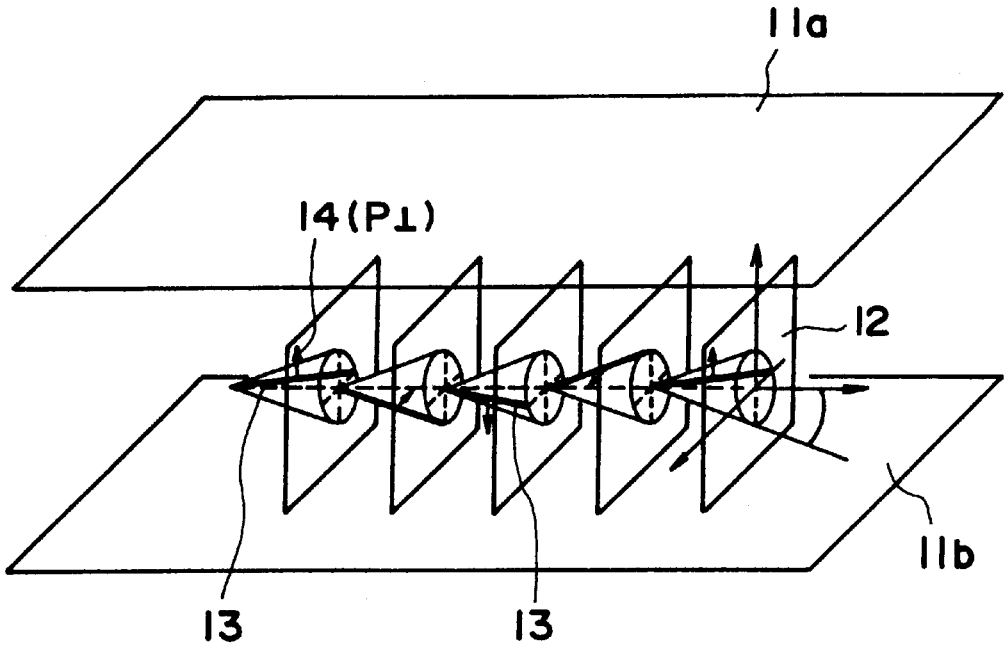
FIGS. 21 and 22 are respectively a schematic perspective view for illustrating an operation principal of a liquid crystal device usable in the invention.

FIG. 21 is a schematic illustration of a ferroelectric liquid crystal cell (device). Reference numerals 11*a* and 11*b* denote substrates (glass plates) on which a transparent electrode of, e.g., $In_2O_3$, $SnO_2$, ITO (indium-tin-oxide), etc., is disposed, respectively. A liquid crystal of an SmC*-phase (chiral smectic C phase) in which liquid crystal molecular layers 12 are aligned perpendicular to surfaces of the glass plates is hermetically disposed therebetween. Full lines 13 represent liquid crystal molecules. Each liquid crystal molecule 13 has a dipole moment (P⊥) 14 in a direction perpendicular to the axis thereof. The liquid crystal molecules 13 continuously form a helical structure in the direction of extension of the substrates. When a voltage higher than a certain threshold level is applied between electrodes formed on the substrates 11*a* and 11*b*, a helical structure of the liquid crystal molecule 13 is unwound or released to change the alignment direction of respective liquid crystal molecules 13 so that the dipole moments (P⊥) 14 are all directed in the direction of the electric field. The liquid crystal molecules 13 have an elongated shape and show refractive anisotropy between the long axis and the short axis thereof. Accordingly, it is easily understood that when, for instance, polarizers arranged in a cross nicol relationship, i.e., with their polarizing directions crossing each other, are disposed on the upper and the lower surfaces of the glass plates, the liquid crystal cell thus arranged functions as a liquid crystal optical modulation device of which optical characteristics vary depending upon the polarity of an applied voltage.

Figure 22:
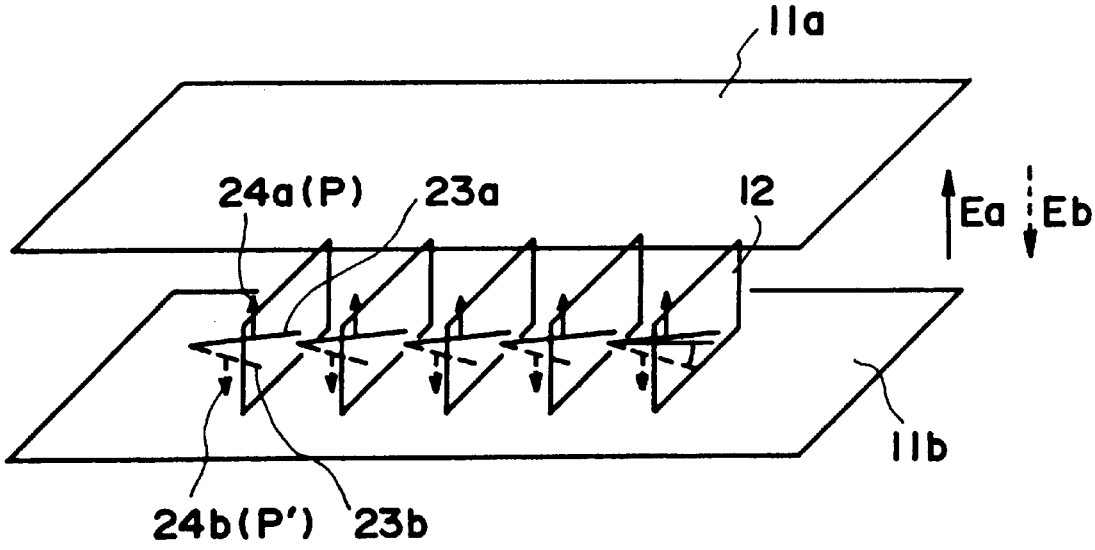

Further, when the liquid crystal cell is made sufficiently thin (e.g., ca. 1 μm), the helical structure of the liquid crystal molecules is unwound to provide a non-helical structure even in the absence of an electric field, whereby the dipole moment assumes either of the two states, i.e., Pa in an upper direction 24*a* or Pb in a lower direction 24*b* as shown in FIG. 22, thus providing a bistable condition. When an electric field Ea or Eb higher than a certain threshold level and different from each other in polarity as shown in FIG. 22 is applied to a cell having the above-mentioned characteristics, the dipole moment is directed either in the upper direction 24*a* or in the lower direction 24*b* depending on the vector of the electric field Ea or Eb. In correspondence with this, the liquid crystal molecules are oriented in either of a first stable state 23*a* and a second stable state 23*b*.

When the above-mentioned ferroelectric liquid crystal is used as an optical modulation element, it is possible to obtain two advantages. First is that the response speed is quite fast. Second is that the orientation of the liquid crystal shows bistability. The second advantage will be further explained, e.g., with reference to FIG. 22. When the electric field Ea is applied to the liquid crystal molecules, they are oriented in the first stable state 23*a*. This state is stably retained even if the electric field is removed. On the other hand, when the electric field Eb of which direction is opposite to that of the electric field Ea is applied thereto, the liquid crystal molecules are oriented to the second stable state 23*b*, whereby the directions of molecules are changed. This state is similarly stably retained even if the electric field is removed. Further, as long as the magnitude of the electric field Ea or Eb being applied is not above a certain threshold value, the liquid crystal molecules are placed in the respective orientation states. In order to realize such quick responsiveness and bistability the cell may preferably be as thin as possible and generally in a thickness of 0.5–20 μm, particularly 1–5 μm. A liquid crystal electrooptical apparatus using such a ferroelectric liquid crystal in combination with an electrode matrix has been proposed in, e.g., U.S. Pat. No. 4,367,924 to Clark and Lagerwall.

Figure 23:
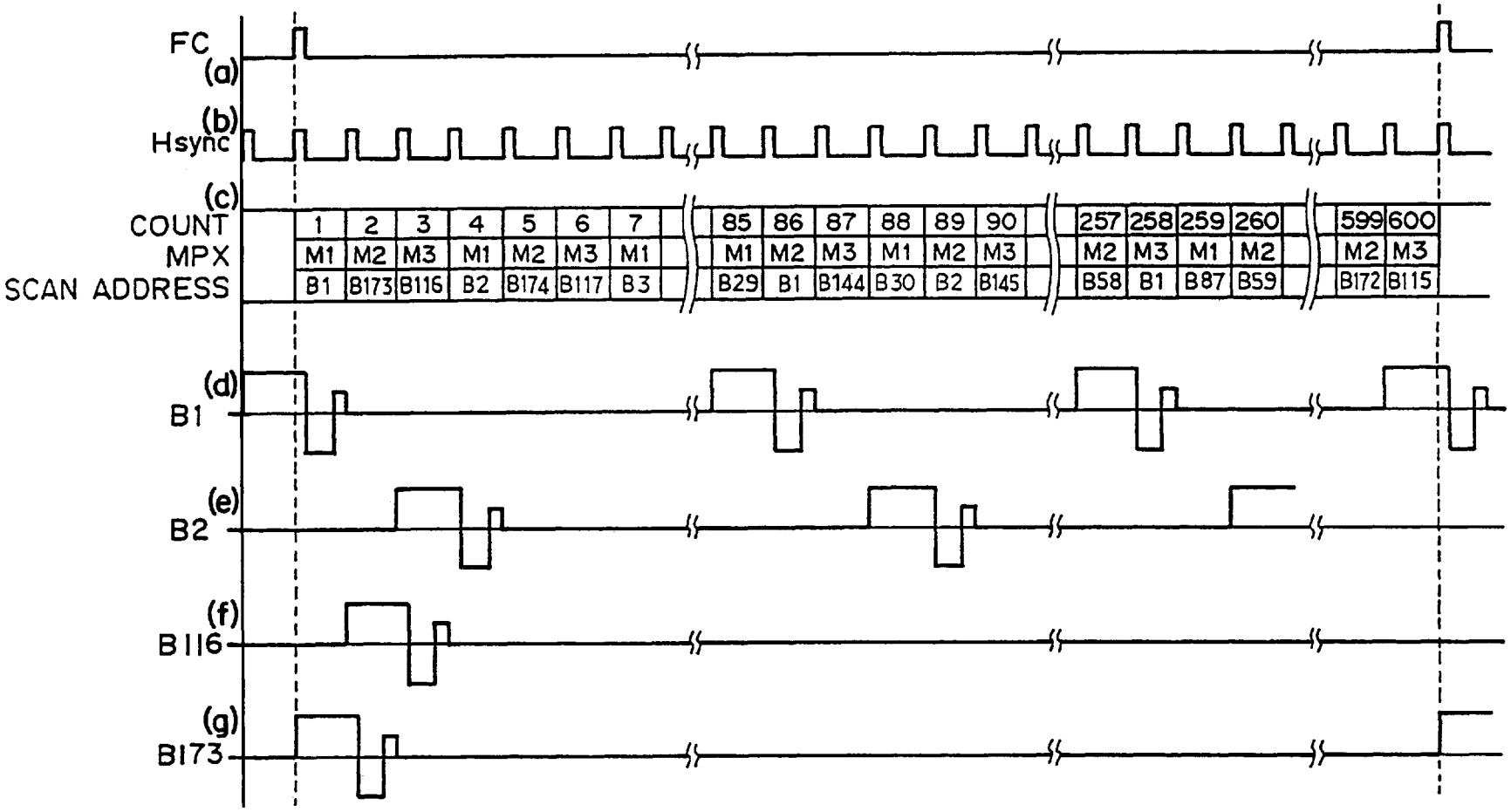
FIG. 23 is a drive time chart for the embodiment shown in FIG. 19.

FIG. 23 is a drive time chart for the system shown in FIG. 18 and for displaying 8 gradations by using three sub-frames. Referring to FIG. 23, FC denotes a frame initiation signal, Hsync denotes a scanning clock signal, MPX denotes a selection line of a multiplexer (not shown) for selecting one of frame memories M1, M2 and M3 not shown, B1–B200 denote scanning electrodes (or addresses), and COUNT represents a number of scanning times in the display unit.

In operation, a frame initiation signal FC is generated to rewrite data in the memories M1–M3. Then, in synchronism with the scanning clock signal Hsync, the selection of sub-frame (MPX) in the multiplexer and the scanning address are changed in the order shown in the following Table 8. Table 9 rewrites the contents of, Table 8 for explanation of the scanning order. The content of MPX is changed sequentially and cyclically in order to M1, M2, M3, M1, M2, M3, . . . for Hsync, and non-interlaced scanning is performed in each sub-frame. The display periods of the 1st, 2nd and 3rd sub-frames are set to a ratio of approximately 1:2:4 by setting the scanning initiation addresses of the respective sub-frames to B1, B173 and B116. For example, when a scanning address B1 is noted, the display period for the first sub-frame is a period of 84×Hsync cycle (interval) in the count range of 2–85, the display period for the second sub-frame is a period of 171×Hsync cycle in the count range of 87–257, and the display period for the third sub-frame is a period of 342×Hsync cycle in the count range of 259–600, whereby the ratios among them are 84:171:342≈1:2:4.1.

TABLE 8

| Count | Sub-frame (MPX) | Scanning address | |
|---|---|---|---|
| 1 | 1 (M1) | B1 | |
| 2 | 2 (M2) | B173 | |
| 3 | 3 (M3) | B116 | |
| 4 | 1 (M1) | B2 | |
| 5 | 2 (M2) | B174 | |
| 6 | 3 (M3) | B117 | |
| 7 | 1 (M1) | B3 | |
| 8 | 2 (M2) | B175 | |
| 9 | 3 (M3) | B118 | |
| 10 | 1 (M1) | B4 | |
| ∫ | ∫ | ∫ | |
| 85 | 1 (M1) | B29 | |
| 86 | 2 (M2) | B1 | |
| 87 | 3 (M3) | B144 | |
| 88 | 1 (M1) | B30 | One frame |
| 89 | 2 (M2) | B2 | |
| 90 | 3 (M3) | B145 | |
| 91 | 1 (M1) | B31 | |
| ∫ | ∫ | ∫ | |
| 257 | 2 (M2) | B58 | |
| 258 | 3 (M3) | B1 | |
| 259 | 1 (M1) | B87 | |
| 260 | 2 (M2) | B59 | |
| 261 | 3 (M3) | B2 | |
| 262 | 1 (M1) | B88 | |
| ∫ | ∫ | ∫ | |
| 595 | 1 (M1) | B199 | |
| 596 | 2 (M2) | B171 | |
| 597 | 3 (M3) | B114 | |
| 598 | 1 (M1) | B200 | |
| 599 | 2 (M2) | B172 | |
| 600 | 3 (M3) | B115 | |

TABLE 9

| | Scanning address | | | |
|---|---|---|---|---|
| Count | M1 | M2 | M3 | |
| 1 | B1 | B173 | | |
| 2 | | | | |
| 3 | | | B116 | |
| 4 | B2 | B174 | | |
| 5 | | | | |
| 6 | | | B117 | |
| 7 | B3 | B175 | | |
| 8 | | | | |
| 9 | | | B118 | |
| 10 | B4 | ∫ | | |
| ∫ | | | | |
| 85 | B29 | | | |
| 86 | | B1 | | |
| 87 | | | B144 | One frame |
| 88 | B30 | | | |
| 89 | | B2 | | |
| 90 | | | B145 | |
| 91 | B31 | | | |
| ∫ | | ∫ | | |
| 257 | | B58 | | |
| 258 | | | B1 | |
| 259 | B87 | | | |
| 260 | | B59 | | |
| 261 | | | B2 | |
| 262 | B88 | | | |
| | | ∫ | | |

TABLE 9-continued

| Count | Scanning address M1 | M2 | M3 |
|---|---|---|---|
| 595 | B199 | | |
| 596 | | B171 | |
| 597 | | | B114 |
| 598 | B200 | B172 | |
| 599 | | | |
| 600 | | | B115 |

Figure 24:
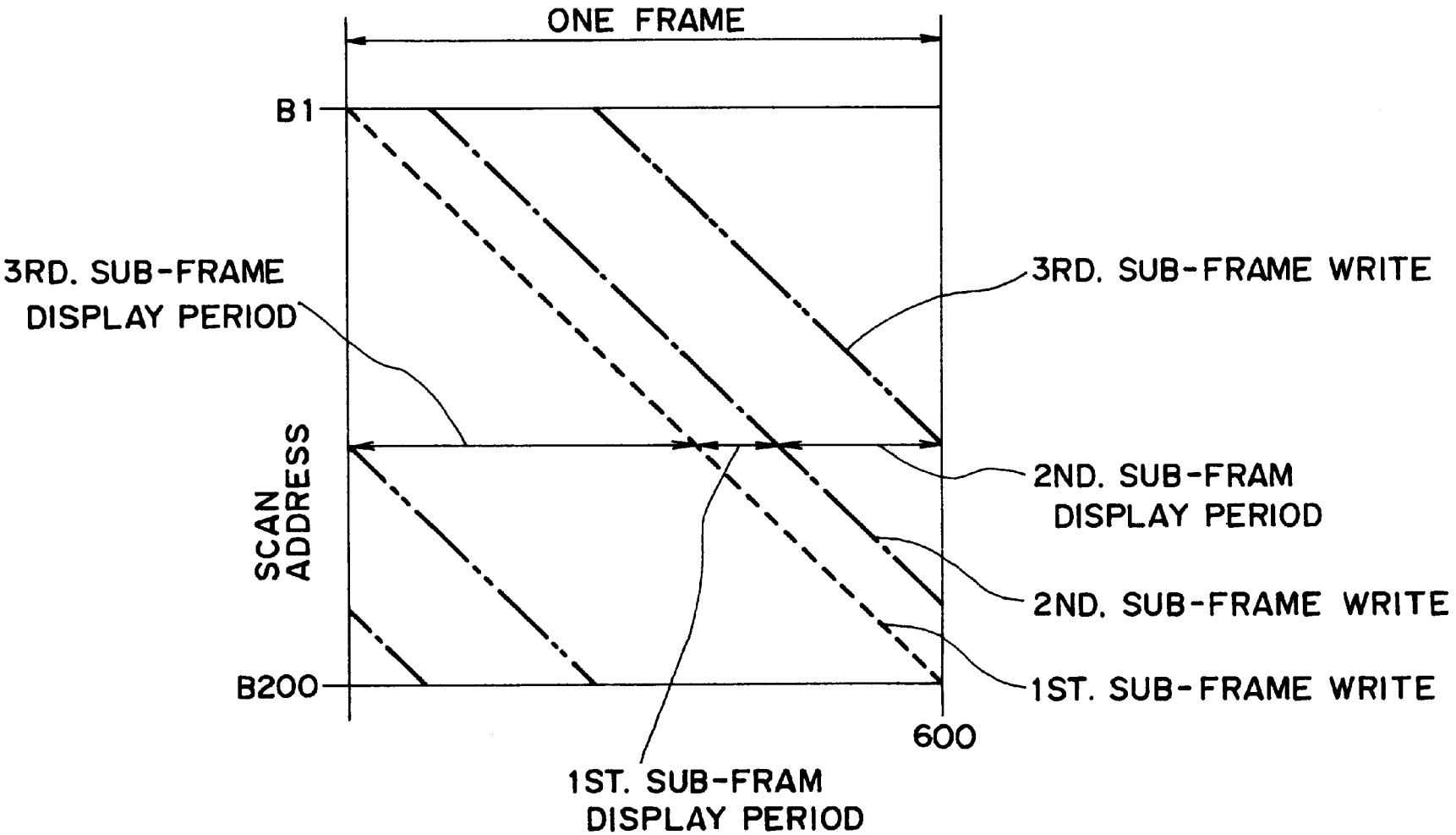
FIG. 24 is a chart for illustrating a relationship between the scanning address and the scanning signal application timing in driving the embodiment shown in FIG. 18.

FIG. 24 is a time chart for illustrating a relationship between the scanning address and the display timing (scanning signal application timing) for the circuit shown in FIG. 18. As is understood from FIG. 24, the intervals of scanning address selection are unequally set within one frame scanning period.

If the content of the temperature data is not changed, the cycle of Hsync is constant and correspondingly the interval of data signal waveform application becomes constant.

On the other hand, if the content of the temperature data is changed, the Hsync cycle is changed so that the data signal waveform application interval is not made constant. However, unless the temperature change is intensive, the change in Hsync cycle is within 10% in one frame so that the data signal waveform application interval can be regarded as substantially constant.

Figure 25:
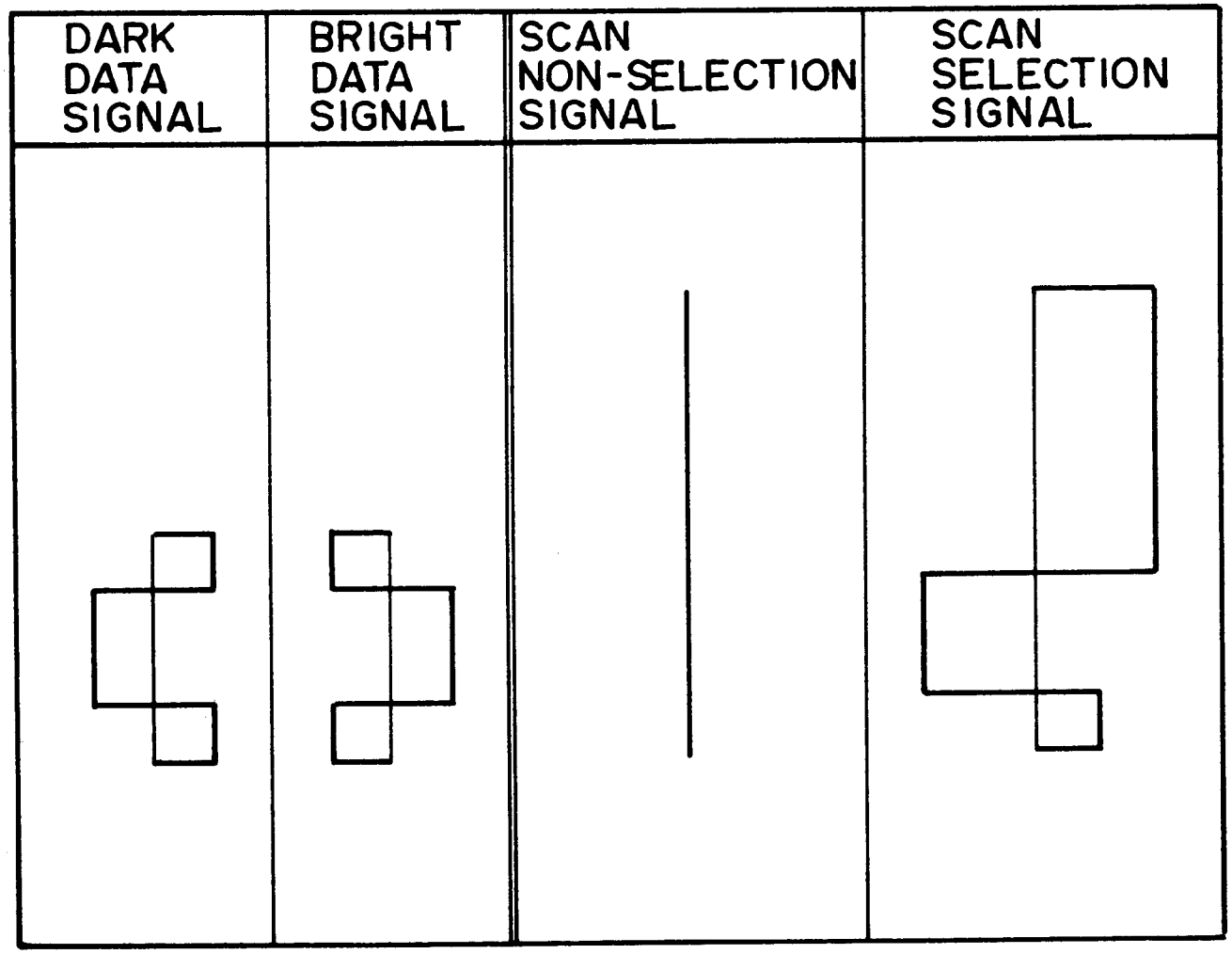
FIG. 25 is a waveform diagram showing a set of drive signals used in driving the embodiment shown in FIG. 18.

FIG. 25 shows a set of drive signals used in driving the embodiment shown in FIG. 18. In this embodiment, the scanning address selection intervals are set to provide ratios of 1:2:4 but the selection interval ratios, i.e., the ratios among display periods for the respective sub-frames can be arbitrarily selected by changing the scanning initiation addresses for the respective sub-frames. For example, if the starting addresses for the respective sub-frames are set to be B1, B183 and B129, ratios of ca 1:3:7 are obtained.

Incidentally, it is possible to provide the respective pixels in this embodiment with color filters to constitute a multi-color display apparatus. Further, by combining the frame modulation scheme with another gradational display scheme, such as a pixel division scheme, it is possible to provide a further increased number of gradations.

Figure 26:
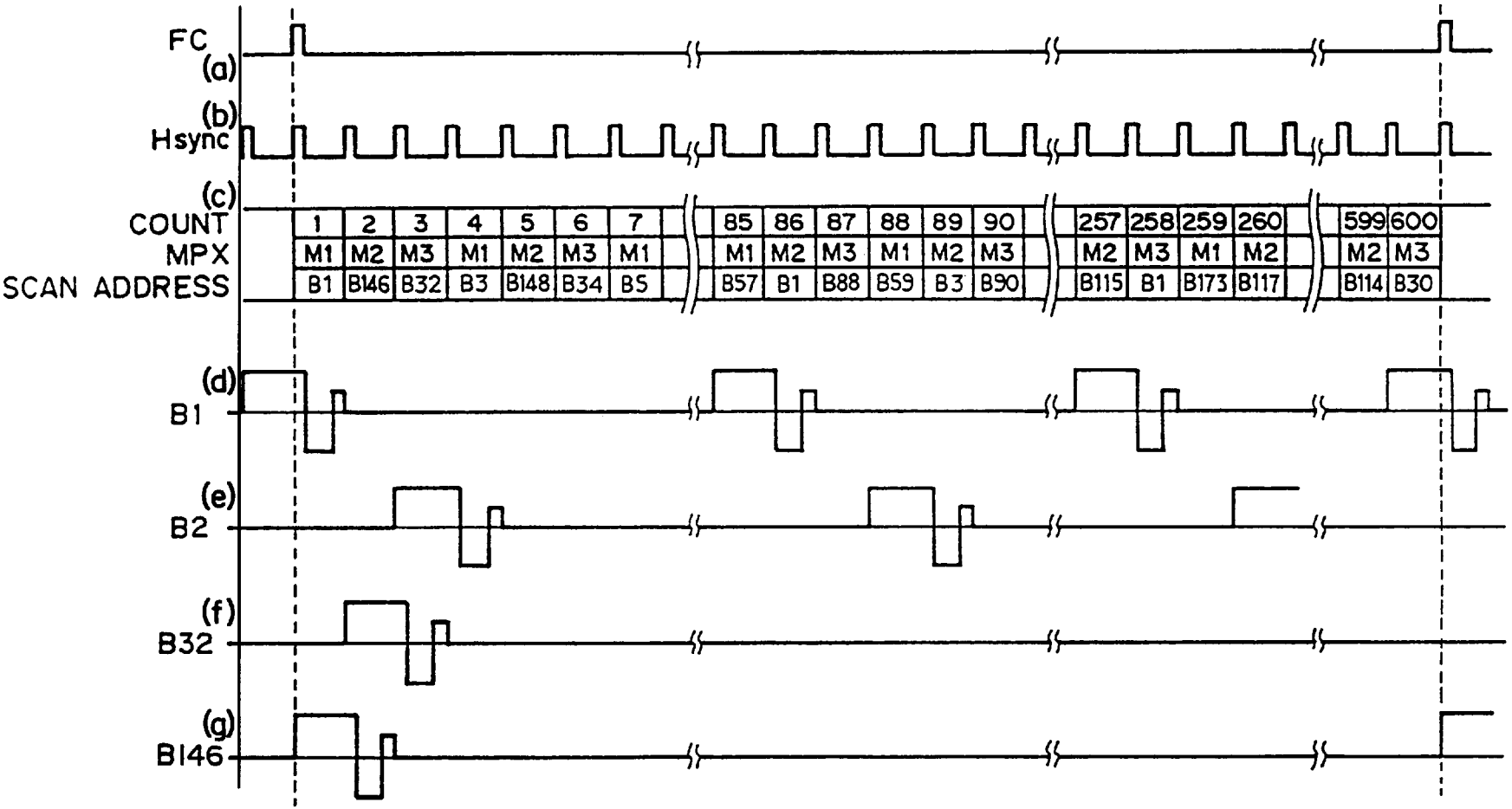
FIG. 26 is a drive time chart for another embodiment of the invention.

FIG. 26 is a time chart for driving the system shown in FIG. 18 according to a different scanning scheme, in which the scanning addresses and MPX are changed in an order shown in Table 10 below. The content of MPX is changed cyclically in the order of M1, M2, M3, M1, M2, M3 . . . for each Hsync, and interlaced scanning is performed in each sub-frame. So as to provide display period ratios of nearly 1:2:4, the scanning initiation addresses of the respective frames are set to the B1, B146 and B32. If interlaced scanning is performed in a sub-frame, it is possible to suppress the occurrence of flicker in a picture particularly in case of a frame frequency as low as 40–20 Hz.

Figure 27:
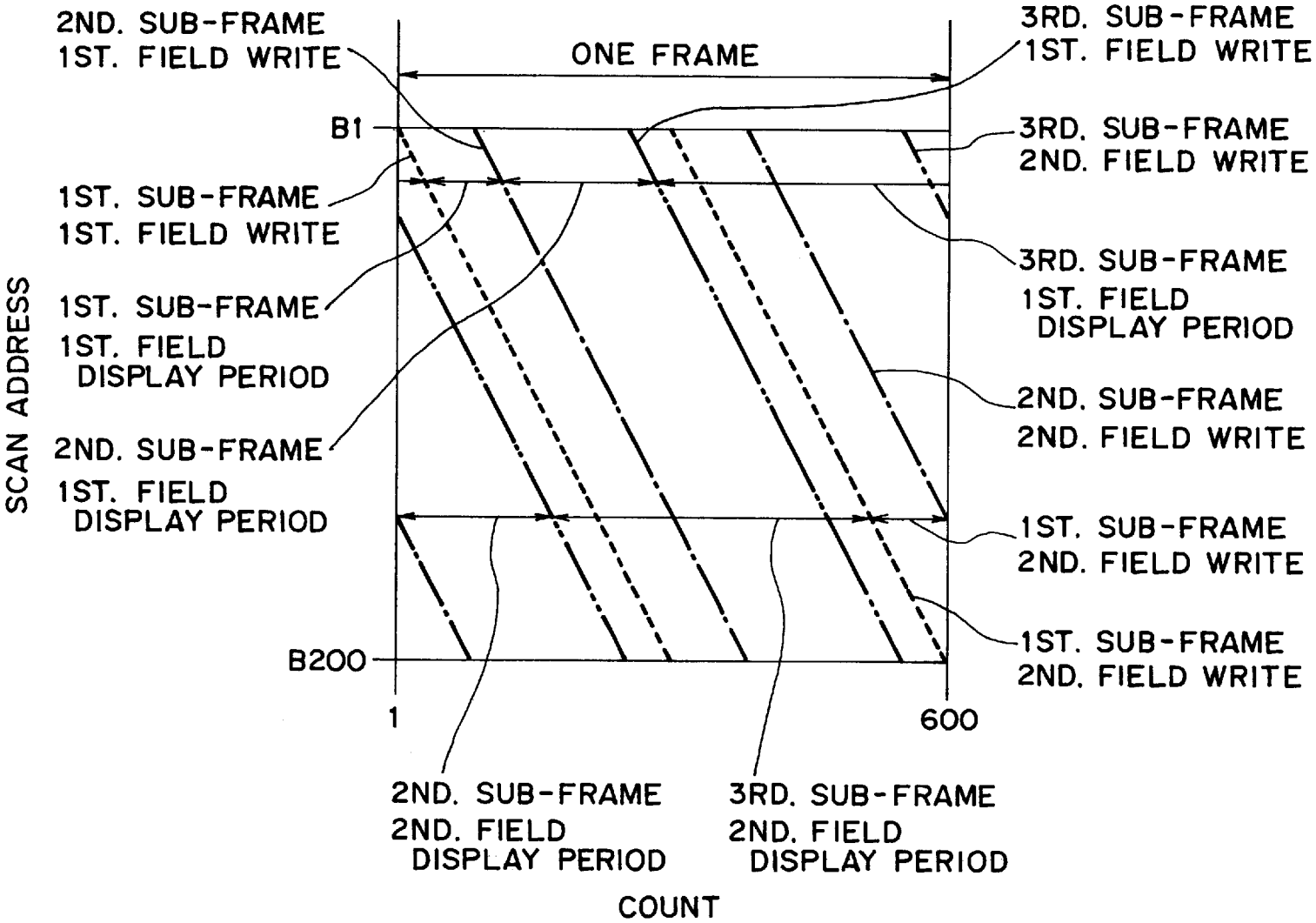
FIG. 27 is a chart for illustrating a relationship between the scanning address and the scanning signal application timing in driving the embodiment of FIG. 26.

FIG. 27 shows a relationship between the scanning address and the display timing in such an interlaced scanning scheme. Referring to FIG. 27, odd-number scanning addresses are selected in a first field and even-numbered scanning addresses are selected in a second field.

A ferroelectric liquid crystal used as an optical modulation substance in this embodiment has a rather remarkable temperature-dependence of response speed so that a slow response speed is given at a low temperature. Accordingly, it is desirable to effect a change between a non-interlaced scanning mode and an interlaced scanning mode within a sub-frame depending on the temperature.

An interlaced scanning mode of selecting every other scanning address has been explained to be used in this embodiment. However, the interlaced scanning can also be performed so as to skip two or more scanning addresses before each selection of a scanning address (so-called multi-interlaced scanning mode) or a random scanning mode can also be adopted in a similar manner.

TABLE 10

| Count | Scanning address M1 | M2 | M3 | |
|---|---|---|---|---|
| 1 | B1 | | | |
| 2 | | B146 | | |
| 3 | | | B32 | |
| 4 | B3 | | | |
| 5 | | B148 | | |
| 6 | | | B34 | |
| 7 | B5 | | | |
| 8 | | B150 | | |
| 9 | | | B36 | |
| 10 | B7 | | | |
| ∫ | | ∫ | | |
| 85 | B57 | | | |
| 86 | | B1 | | |
| 87 | | | B88 | One Frame |
| 88 | B59 | | | |
| 89 | | B3 | | |
| 90 | | | B90 | |
| 91 | B61 | | | |
| ∫ | | ∫ | | |
| 257 | | B115 | | |
| 258 | | | B1 | |
| 259 | B173 | | | |
| 260 | | B117 | | |
| 261 | | | B3 | |
| 262 | B175 | | | |
| | | ∫ | | |
| 595 | B198 | | | |
| 596 | | B142 | | |
| 597 | | | B28 | |
| 598 | B200 | | | |
| 599 | | B144 | | |
| 600 | | | B30 | |

Figure 28:
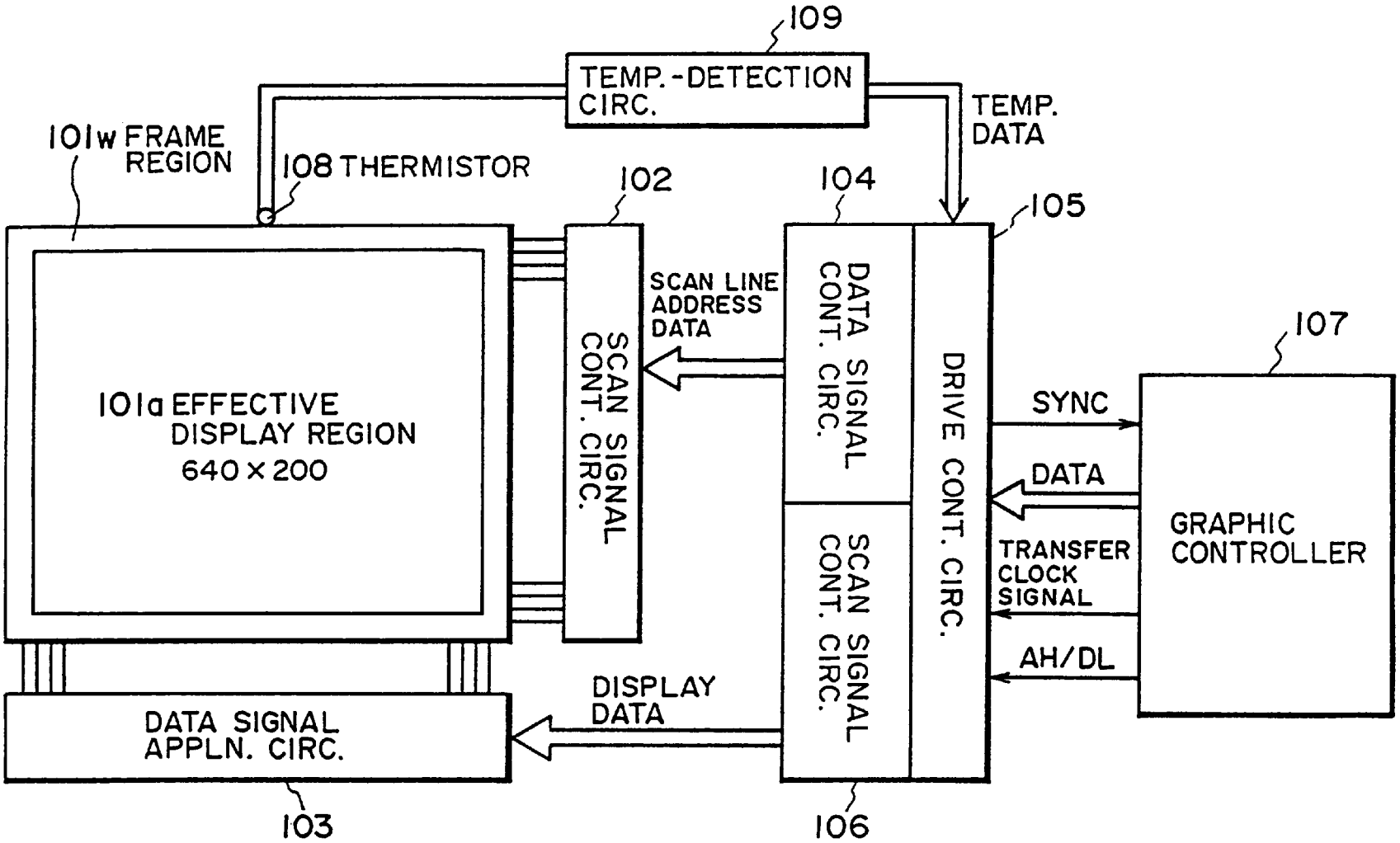
FIG. 28 is a block diagram of still another embodiment of the invention.

FIG. 28 is a block diagram of still another embodiment of the display apparatus according to the present invention. Referring to FIG. 28, the display apparatus includes a display unit (panel) comprising an effective display region 101*a* and a frame region 101*b*.

Figure 29:
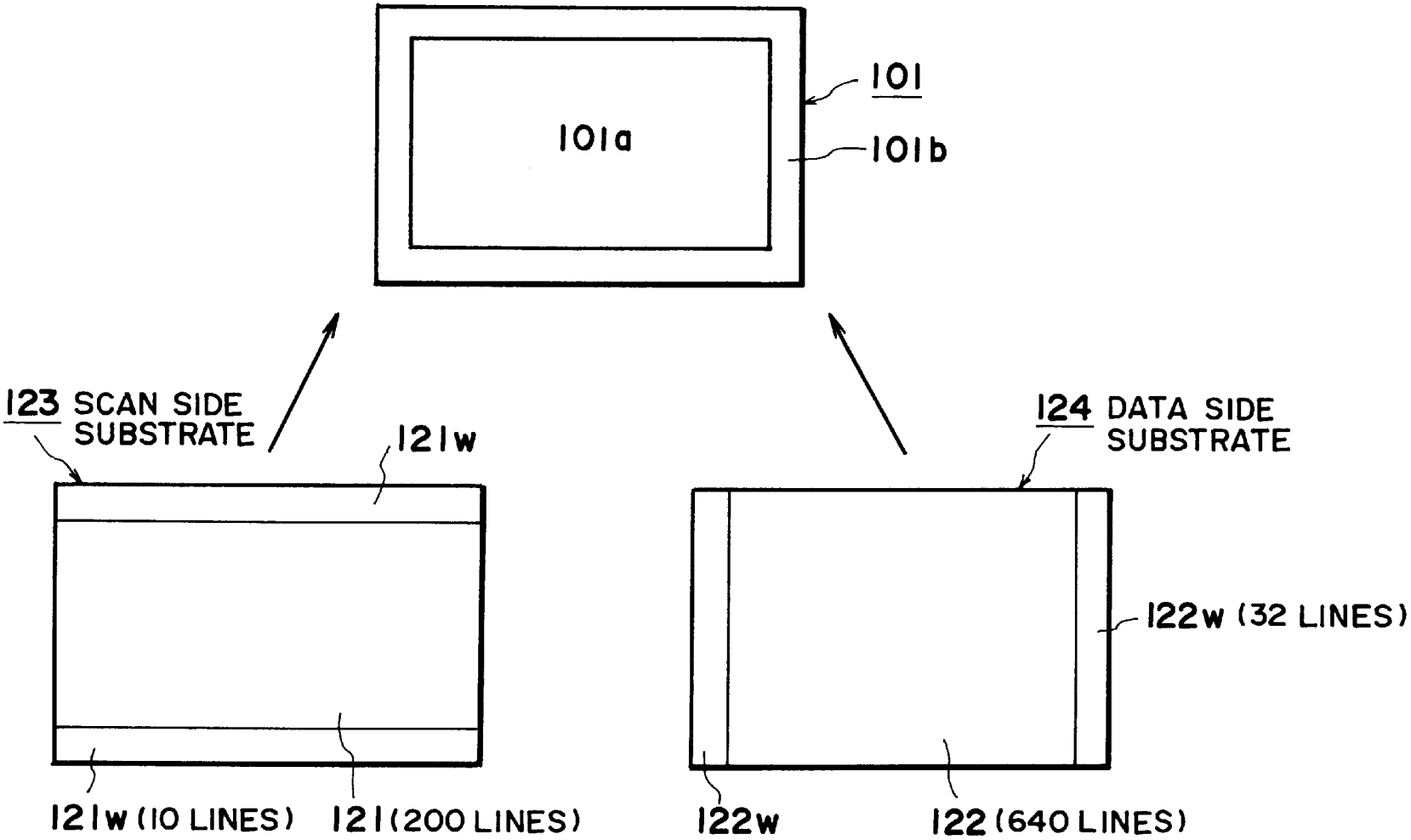
FIG. 29 is a view for illustrating a structure of the embodiment shown in FIG. 28.

As illustrated in FIG. 29, one substrate 123 is provided with frame scanning electrodes 121*w* on both sides of scanning electrodes 121, and another substrate 124 is provided with frame data electrodes 122*w* on both sides of data electrodes 122. By applying the pair of substrates to each other it is possible to constitute the display unit 101 having a frame region 101*b* shown in FIG. 28. By disposing such a frame region 101*b*, the following effects may be attained.

A display device is generally held in a chassis or a decorative case for improving the functionality, safety or appearance and also for protecting the electrical system. In this instance, if the chassis or decorative case has a certain thickness, the display face of the display device can be hidden by the thickness when viewed from an oblique direction. In order to obviate such a difficulty, the display region (effective display region) may be surrounded by a frame region (non-display region) so as not to hide the effective display region unless it is viewed from an extreme direction outside a certain angle.

In case where such a frame region is provided, however, if the frame region is constituted by an optical modulation substance, such as a ferroelectric liquid crystal, having a memory characteristic, the optical modulation substance remains in an arbitrary uncontrolled state until it is supplied with an electric signal exceeding a threshold, and the frame region exhibits an uniform display state giving an ugly appearance. In order to obviate the difficulty, it is desirable to uniformize the display state of the frame region by applying certain electric signals. The memory characteristic referred to herein is, however, not necessarily a permanent one, within an extent of retaining the image quality and display function. Accordingly, it is desired to periodically supply drive signals to the frame region.

For the above purpose, frame-region drive electrodes are disposed outside the effective display region and are supplied with electric signals to drive the liquid crystal, thus providing a uniform state in the frame region.

The display apparatus shown in FIG. 28 has an identical structure to the one shown in FIG. 18 except for the display unit 101.

Figure 30:
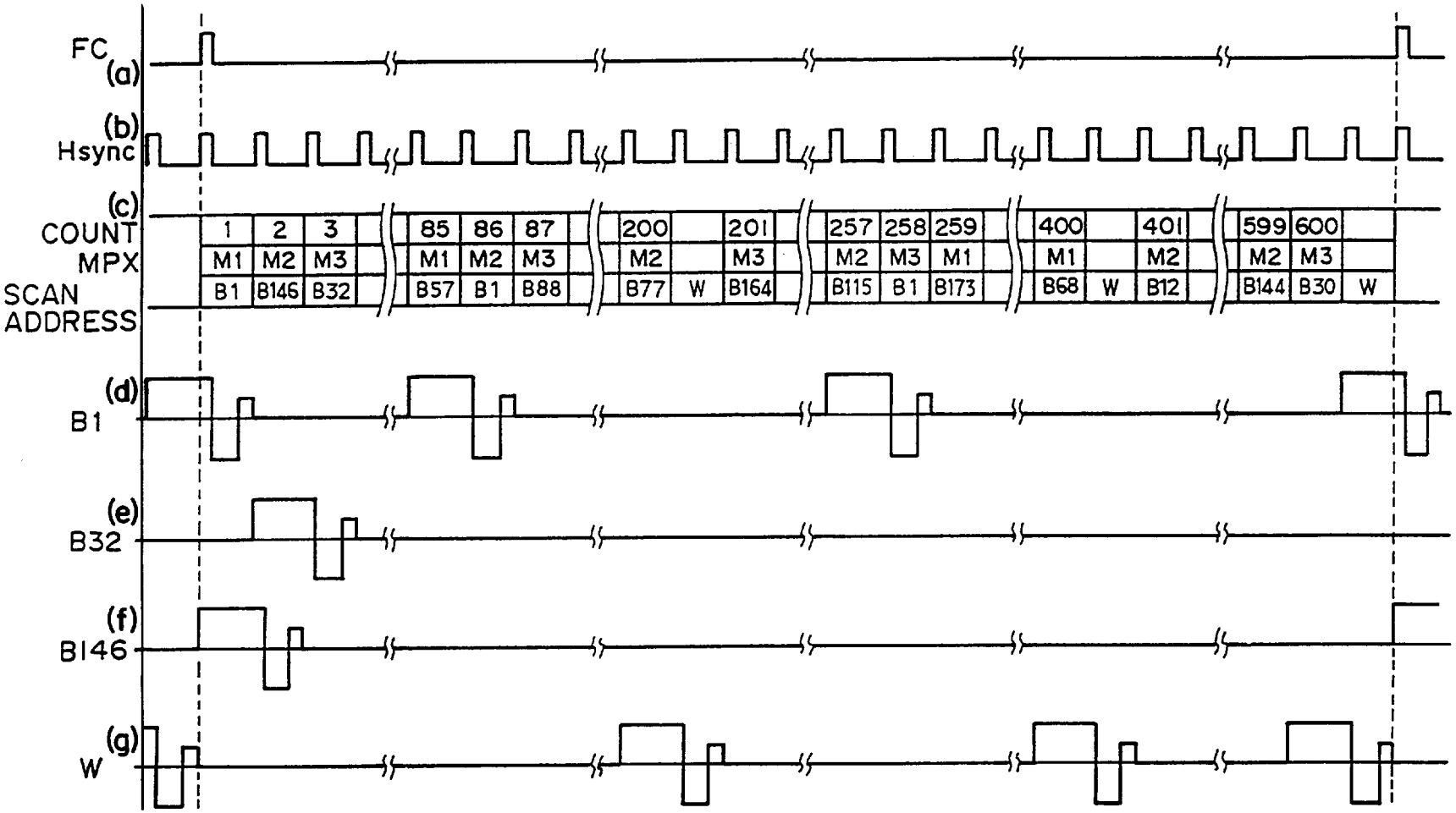
FIG. 30 is a drive time chart for the embodiment shown in FIG. 28.

FIG. 30 is a drive time chart for the display apparatus shown in FIG. 28 and for displaying 8 gradations by using three sub-frames. The drive scheme shown in FIG. 30 includes a waveform shown at W to be applied to the frame scanning electrodes (or scanning addresses) and is otherwise identical to the one described with reference to FIG. 26.

First, a frame initiation signal FC is generated to rewrite data in the memories M1–M3. Then, in synchronism with the scanning clock signal Hsync, the content of selection by the multiplexer (MPX) and scanning address are changed in an order as shown in Table 11 below. The content of MPX is changed cyclically in the order of M1, M2, M3, M1, M2, M3, . . . for each Hsync, and interlaced scanning is performed in each sub-frame. For example, in a 1st sub-frame, the selection is performed in the order of B1, B3, B5, . . . , B199, B2, B4, . . . , B200. Then, if the count reaches 200, 400 or 600, the counting is stopped, and the frame scanning addresses are selected. In case where the frame frequency is 20–40 Hz, the frame scanning frequency amounts to 60–120 Hz so that flicker due to the frame scanning can be obviated. In this embodiment, the frame scanning is performed at the time of 200 counts each, but the number of 200 counts need not be observed. Further, the frame scanning need not be performed on a count basis but can also be made at a fixed time interval of, e.g., 10 msec.

TABLE 11

| | Scanning address | | | |
|---|---|---|---|---|
| Count | M1 | M2 | M3 | |
| 1 | B1 | | | |
| 2 | | B146 | | |
| 3 | | | B32 | |
| 4 | B3 | | | |
| 5 | | B148 | | |
| 6 | | | B34 | |
| 7 | B5 | | | |
| 8 | | B150 | | |
| 9 | | | B36 | |
| 10 | B7 | | | |
| ∫ | | ∫ | | |

TABLE 11-continued

| | Scanning address | | | | |
|---|---|---|---|---|---|
| Count | M1 | M2 | M3 | | |
| 85 | B57 | | | | |
| 86 | | B1 | | | |
| 87 | | | B88 | | |
| 88 | B59 | | | | One frame |
| 89 | | B3 | | | |
| 90 | | | B90 | | |
| 91 | B61 | | | | |
| ∫ | | ∫ | | | |
| 200 | | B77 | | | |
| | | | | W | |
| 201 | | | B164 | | |
| ∫ | | ∫ | | | |
| 257 | | B115 | | | |
| 258 | | | B1 | | |
| 259 | B173 | | | | |
| 260 | | B117 | | | |
| 261 | | | B3 | | |
| 262 | B175 | | | | |
| ∫ | | ∫ | | | |
| 400 | B68 | | | | |
| | | | | W | |
| 401 | | B12 | | | |
| ∫ | | ∫ | | | |
| 595 | B198 | | | | |
| 596 | | B142 | | | |
| 597 | | | B28 | | |
| 598 | B200 | | | | |
| 599 | | B144 | | | |
| 600 | | | B30 | W | |

W: frame scan

Figure 31:
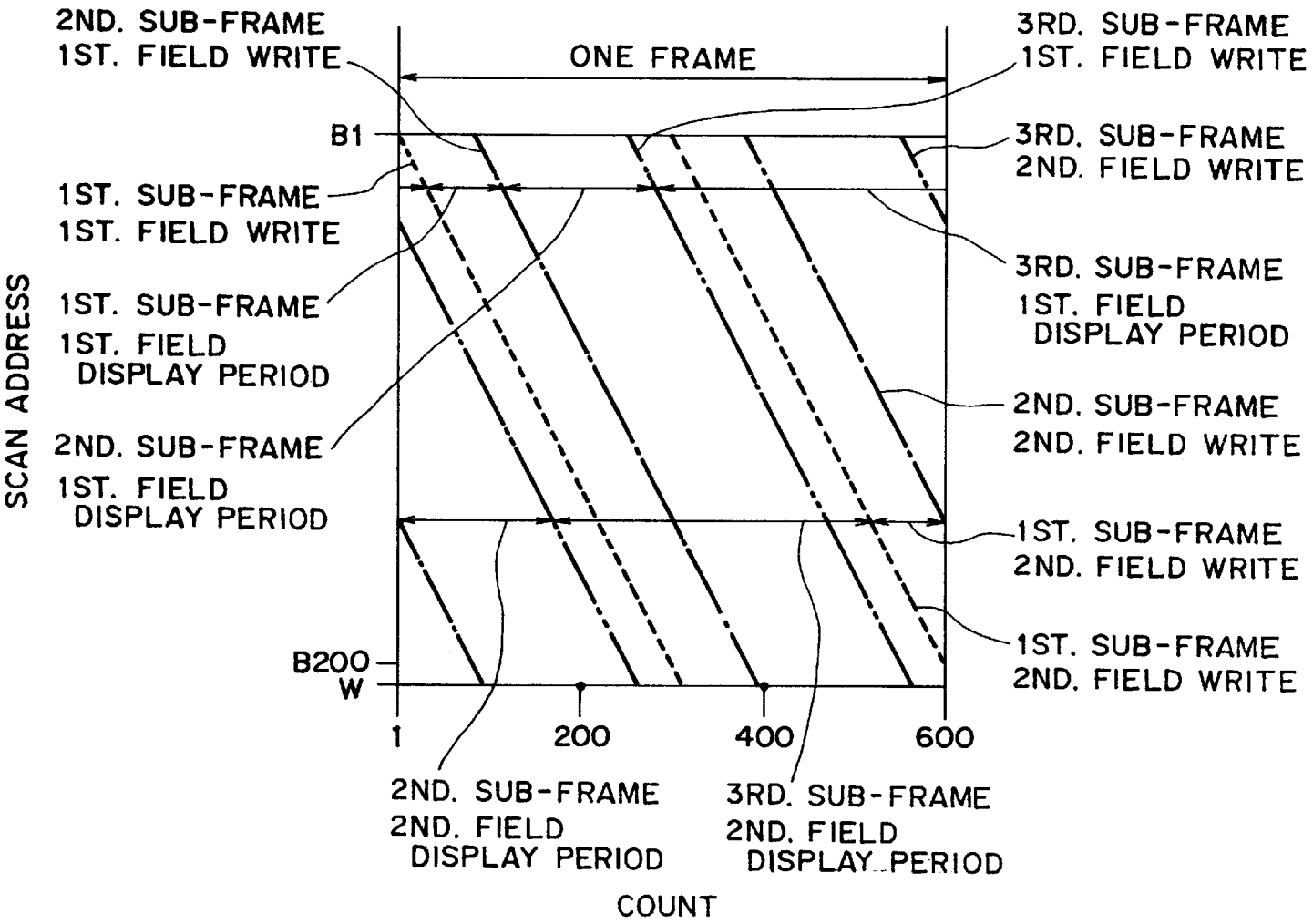
FIG. 31 is a chart for illustrating a relationship between the scanning address and the scanning signal application timing in driving the embodiment shown in FIG. 28.
Figure 32:
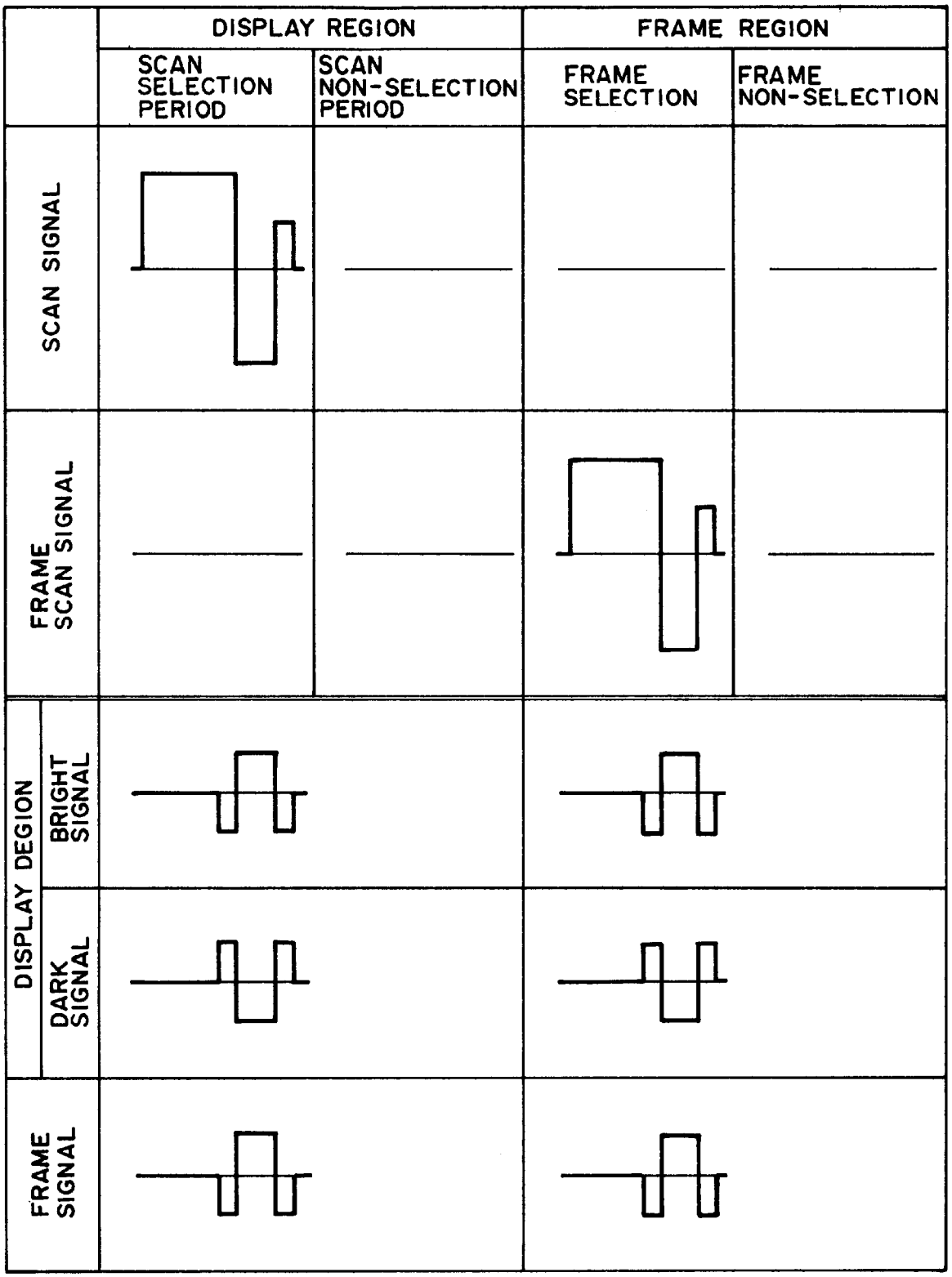
FIG. 32 is a waveform diagram showing a set of drive signals used in driving the embodiment shown in FIG. 28.
Figure 33:
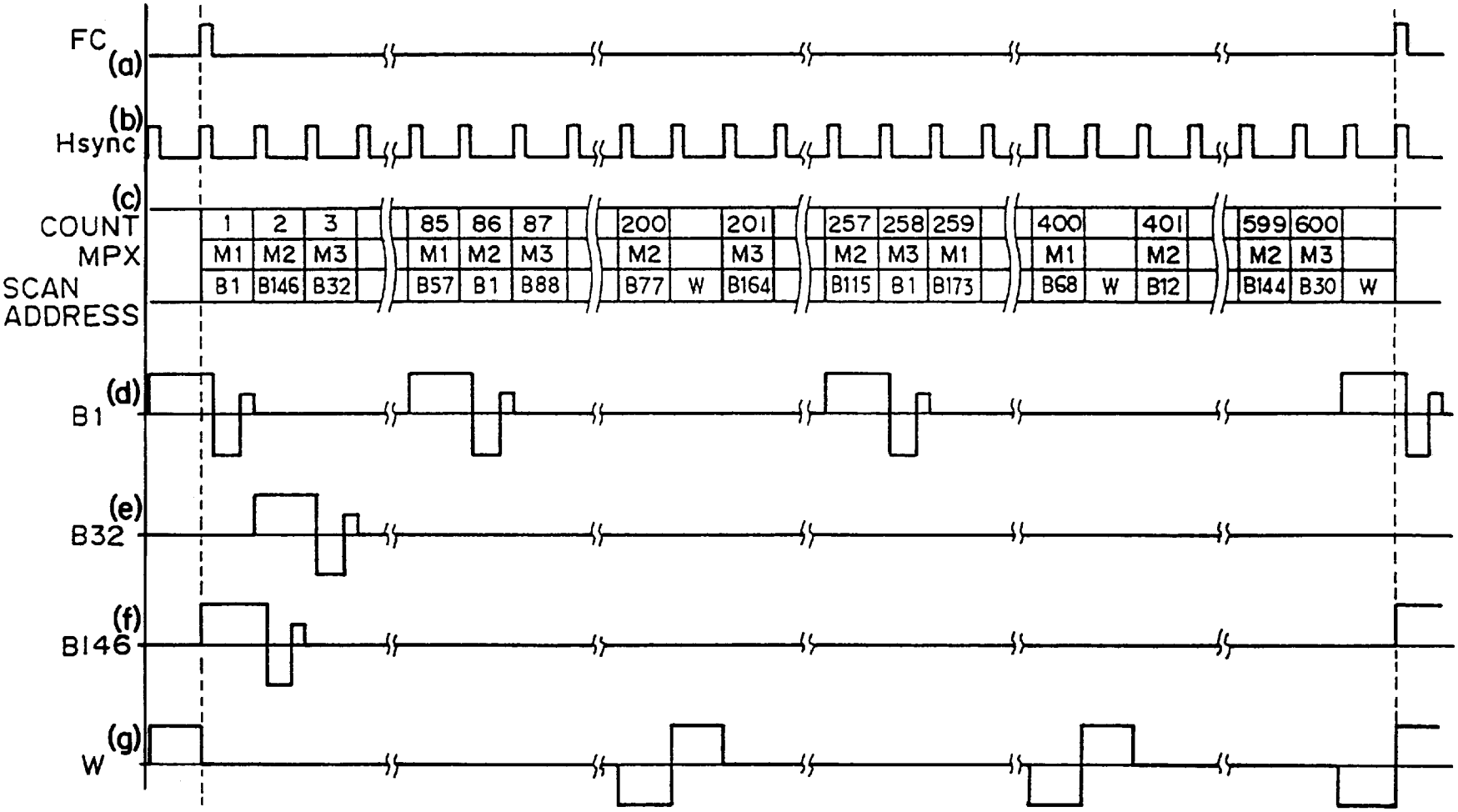
FIGS. 33 and 34 are respectively a waveform diagram showing another set of drive signals used in driving the embodiment shown in FIG. 28.

FIG. 31 briefly illustrates a relationship between the scanning address and the display timing. In view of FIG. 31 in comparison with FIG. 27, it would be understood that the frame scanning is performed immediately after the counts 200, 400 and 600, respectively FIG. 32 shows a set of drive signal waveforms used in this embodiment. FIG. 33 is a time chart identical to the one shown in FIG. 30 except for the use of a frame scanning signal of a different waveform included in a set of drive signals shown in FIG. 34.

Next, an embodiment of displaying four gradations by using the display apparatus shown in FIG. 18. In this embodiment two frame memories M1 and M2 are used so as to constitute one frame (400 counts) with two sub-frames. MPX and scanning addresses are selected in the order of Table 12 below to provide a ratio of 1:2 between the display periods of the respective sub-frames. On the other hand, a ratio of 1:3 can be obtained if the selection order is taken as shown in Table 13.

Figure 35:
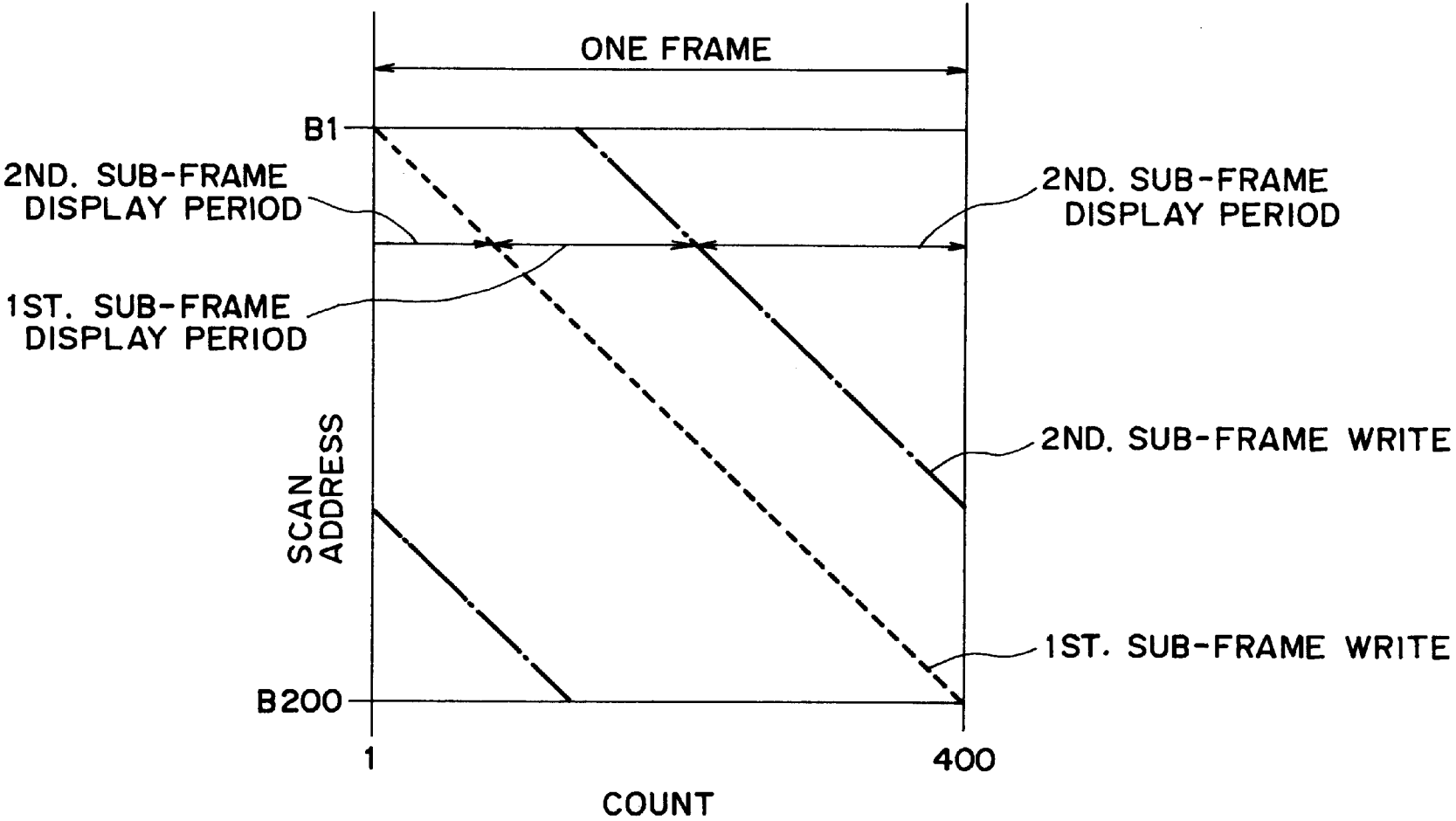
FIG. 35 is a drive time chart for a further embodiment of the invention.
Figure 36:
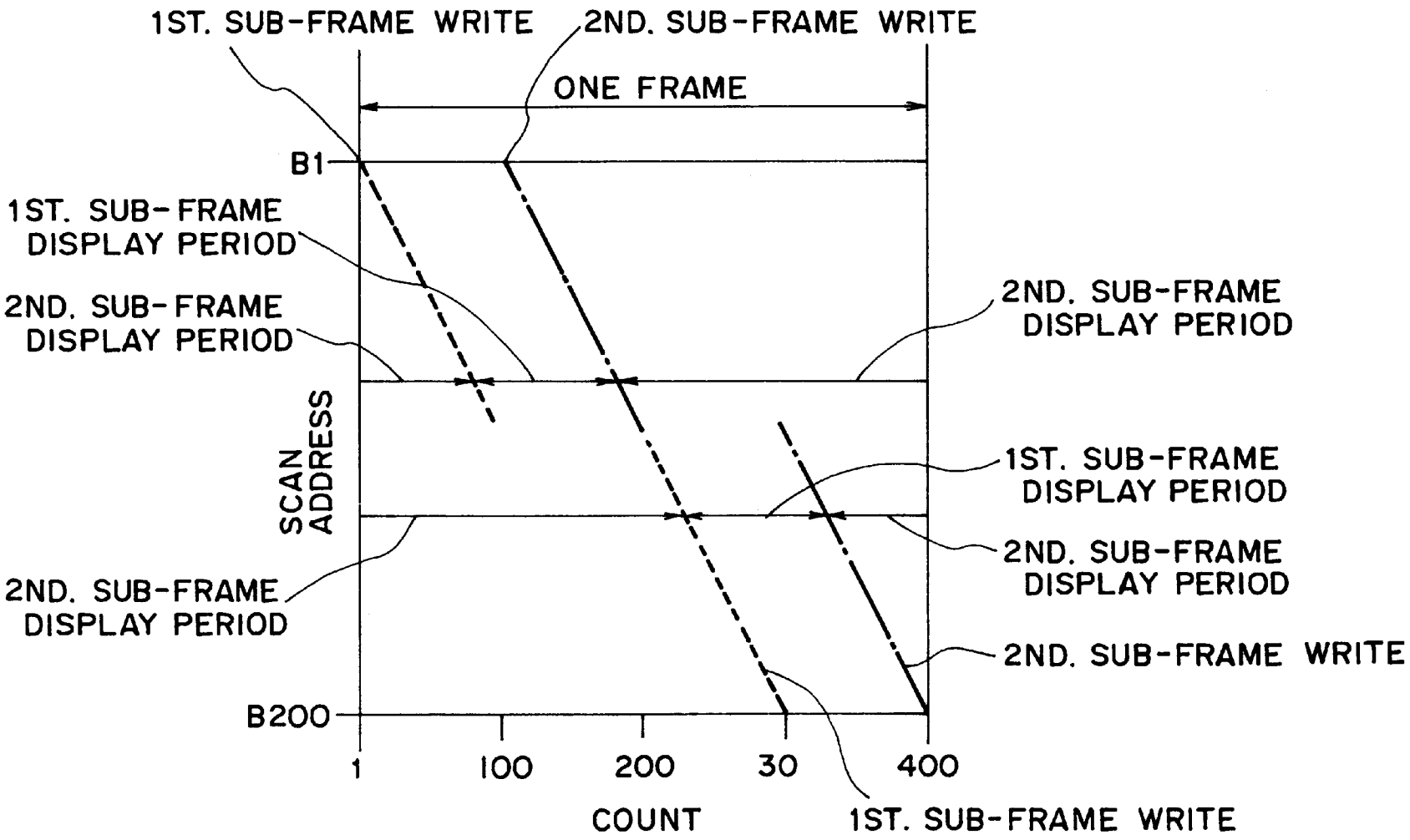
FIG. 36 is another drive time chart for the further embodiment of the invention.

FIGS. 35 and 36 respectively show a relationship between the scanning address and the display timing when the selection order is taken as shown in Table 12 and Table 13, respectively.

TABLE 12

| Count | Scanning address MPX | M1 | M2 | |
|---|---|---|---|---|
| 1 | M1 | B1 | | |
| 2 | M2 | | B135 | |
| 3 | M1 | B2 | | |
| 4 | M2 | | B136 | |
| 5 | M1 | B3 | | |
| 6 | M2 | | B137 | |
| 7 | M1 | B4 | | |
| 8 | M2 | | B138 | |
| 9 | M1 | B5 | | |
| 10 | M2 | | B139 | |
| ∫ | | | ∫ | |
| 133 | M1 | B67 | | |
| 134 | M2 | | B1 | |
| 135 | M1 | B68 | | |
| 136 | M2 | | B2 | One frame |
| 137 | M1 | B69 | | |
| 138 | M2 | | B3 | |
| 139 | M1 | B70 | ∫ | |
| ∫ | | | | |
| 264 | M2 | | B66 | |
| 265 | M1 | B133 | | |
| 266 | M2 | | B67 | |
| 267 | M1 | B134 | | |
| 268 | M2 | | B68 | |
| 269 | M1 | B135 | | |
| ∫ | | | ∫ | |
| 395 | M1 | B198 | | |
| 396 | M2 | | B132 | |
| 397 | M1 | B199 | | |
| 398 | M2 | | B133 | |
| 399 | M1 | B200 | | |
| 400 | M2 | | B134 | |

TABLE 13

| Count | Scanning address MPX | M1 | M2 | |
|---|---|---|---|---|
| 1 | M1 | B1 | | |
| 2 | M1 | B2 | | |
| 3 | M1 | B3 | | |
| 4 | M1 | B4 | | |
| 5 | M1 | B5 | | |
| 6 | M1 | B6 | | |
| 7 | Ml | B7 | | |
| ∫ | | | ∫ | |
| 98 | M1 | B98 | | |
| 199 | M1 | B99 | | |
| 100 | M1 | B100 | | |
| 101 | M2 | | B1 | One frame |
| 102 | M2 | | B2 | |
| 103 | M2 | | B3 | |
| ∫ | | | ∫ | |
| 198 | M2 | | B98 | |
| 199 | M2 | | B99 | |
| 200 | M2 | | B100 | |
| 201 | M1 | B101 | | |
| 202 | M1 | B102 | | |
| 203 | M1 | B103 | | |
| ∫ | | | ∫ | |

TABLE 13-continued

| Count | Scanning address MPX | M1 | M2 |
|---|---|---|---|
| 298 | M1 | B198 | |
| 299 | M1 | B199 | |
| 300 | M1 | B200 | |
| 301 | M2 | | B101 |
| 302 | M2 | | B102 |
| 303 | M2 | | B103 |
| ∫ | | | ∫ |
| 398 | M2 | | B198 |
| 2399 | M2 | | B199 |
| 400 | M2 | | B200 |

If the frame modulation scheme show in FIG. 36 (and Table 13) is adopted, the weight of each sub-frame becomes identical for the pixels on all the scanning lines even when a partial rewrite scheme is used in combination as has been described in detail with reference to FIG. 14.

On the other hand, in case where the frame modulation scheme shown in FIG. 35 (and Table 12) is adopted, if a partial rewrite period is added thereto, the weights of the sub-frames can be different depending on the scanning lines concerned.

In this way, the frame modulation scheme shown in FIG. 36 allows a combination with a partial rewrite scheme and provides a display with a good responsiveness.

Then, another embodiment of display apparatus driven by combination of whole picture scanning and partial rewrite scanning will be described with reference to FIG. 37.

Figure 37:
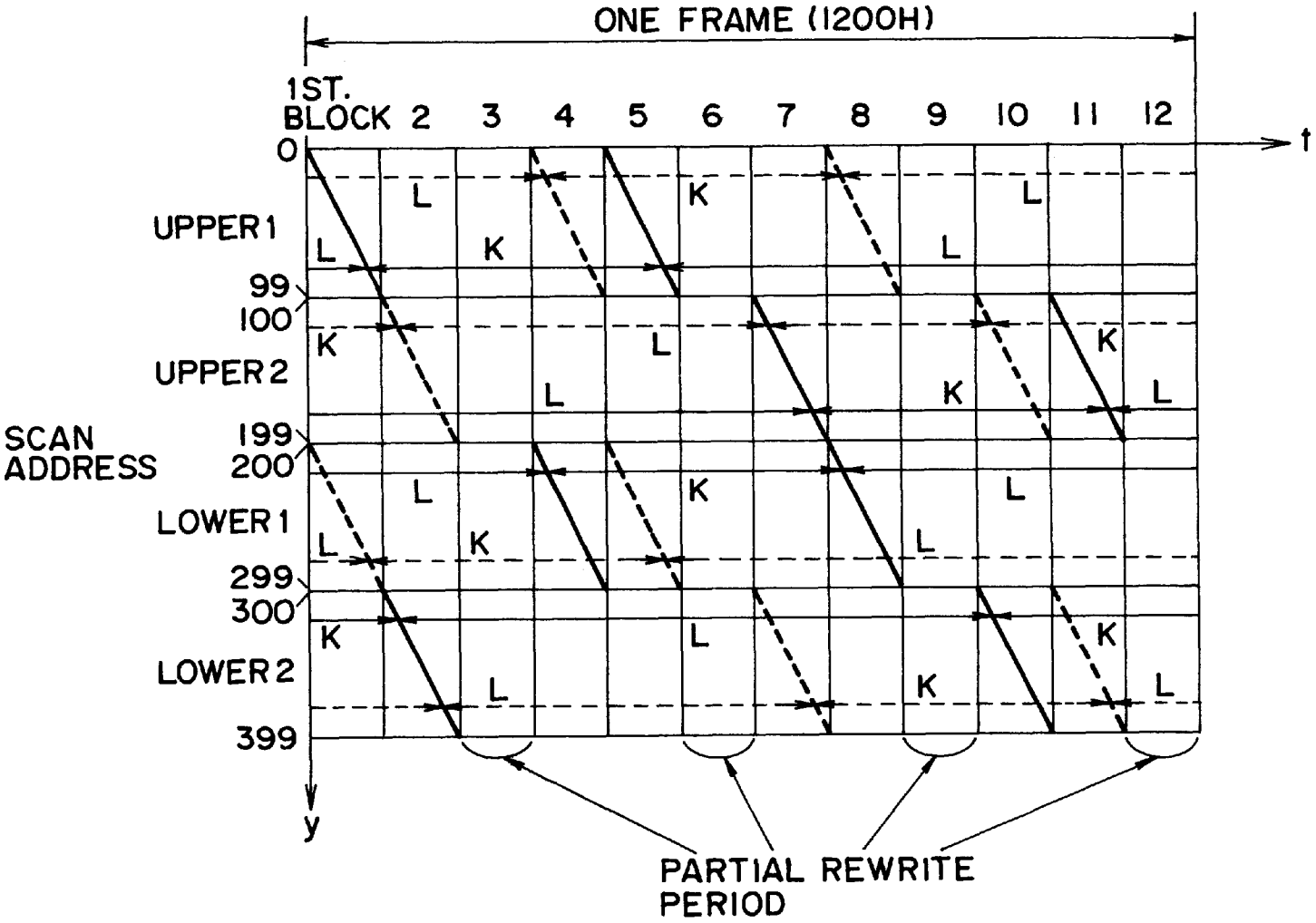
FIGS. 37 and 38 are respectively a chart for illustrating a relationship between the scanning address and the scanning signal application time in driving a still further embodiment of the invention.

FIG. 37 is a scanning chart showing a relationship between the scanning address and the scanning signal application timing. A display device used in this embodiment has 640×400 pixels (640 data lines and 400 scanning lines) and is driven to display four gradations in both the whole picture scanning and the partial rewrite scanning. In the whole picture scanning, interlaced scanning is performed.

In FIG. 37, the y-axis represents scanning electrode addresses and the t-axis represents time with one horizontal scanning period (1 H) as a unit. In this embodiment, one frame includes 1200 H for 1200 times of scanning selection, of which 800 times (800 H) are used for the whole picture scanning and 400 times (400 H) are used for the partial rewrite scanning. One frame is divided into 12 blocks including 1st, 2nd, 4th, 5th, 7th, 8th, 10th and 11th blocks as the whole picture scanning period, and 3rd, 6th, 9th and 12th blocks as the partial rewrite scanning period. The whole picture scanning period is used for scanning all of the 400 scanning addresses two times each in one frame regardless of whether the display content is changed or not, thereby displaying a halftone. On the other hand, the partial rewrite scanning period is used for selecting arbitrary scanning addresses including a change in display content and is set to allow four sets of scanning selection each including 100 times of scanning selection.

In the whole picture scanning, the whole scanning addresses are assumed to be composed of an upper 1 unit including scanning addresses of 0–99, an upper 2 unit including scanning addresses of 100–199, a lower 1 unit including scanning addresses of 200–299, and a lower 2 unit including scanning addresses of 300–399. Then, interlaced scanning is performed so as to effect 1st scanning of upper 1 even-numbered addresses and lower 1 odd-numbered addresses in the 1st block; 1st scanning of upper 2 odd-numbered addresses and lower 2 even-numbered addresses in the 2nd block; 1st scanning of upper 1 odd-numbered addresses and lower 1 even-numbered addresses in the 4th block; 2nd scanning of upper 1 even-numbered addresses and lower 1 odd-numbered addresses in the 5th block; 1st scanning of upper 2 even-numbered addresses and lower 2 odd-numbered addresses in the 7th block; 2nd scanning of upper 1 odd-numbered addresses and lower 1 even-numbered addresses in the 8th block; 2nd scanning of upper 2 odd-numbered addresses and lower 2 even-numbered addresses in the 10th block; and 2nd scanning of upper 2 even-numbered addresses and lower 2 odd-numbered addresses in the 11th block. As a result of the scanning selection according to the above-mentioned schedule (timing), all the scanning addresses are provided with a ratio between the display periods K and L of 1:2. In FIG. 37, the scanning of even-numbered addresses is represented by a solid line, and the scanning of odd-numbered addresses is represented by a dashed line. The ratio of a reset period and a period between one scanning selection to a subsequent scanning selection is 1:400 or 1:800, so that the reset period can be ignored. In the partial rewrite scanning periods of the 3rd, 6th, 9th and 12th blocks, the control is performed in a similar manner as in the embodiment of FIG. 14. As a result, also in this embodiment, four gradations can be displayed and similar effects can be attained.

Incidentally, in case where the display content is not changed, the partial rewrite operation is not required essentially, but it is preferred that the partial rewrite period is not shortened so as to retain the gradation. Further, in order to retain the contrast, it is preferred to continually apply waveforms identical to the data signals. It is possible to use the above-mentioned liquid crystal display device together with a color filter of three colors so as to effect a multi-color display with three pixels as a unit.

Some experiment were performed by us in order to confirm the effects of the present invention and will be described below.

(Experimental Example 1)

A liquid crystal display device of 320×200 pixels was constituted by using a chiral smectic liquid crystal showing the following properties:

Ps=6.1 nC/cm$^2$ (30° C.)

Tilt angle=14.6 deg. (30° C.)

$\Delta\epsilon$=−0.2 (30° C.) Phase transition series (°C.):

$$\text{Iso.} \underset{91.9}{\overset{91.5}{\rightleftharpoons}} \text{Ch.} \underset{85.7}{\overset{85.0}{\rightleftharpoons}} \text{SmA} \overset{66.7}{\rightleftharpoons} \text{SmC}^* \underset{-12.5}{\overset{-16.7}{\rightleftharpoons}} \text{Cryst.}$$

The liquid crystal device was driven by the drive scheme described with reference to FIG. 14 by using a set of drive signals shown in FIG. 12 with the following parameters.

V1=20 volts

V2=−14 volts

V3=6.6 volts

V4=6 volts

V5=−6 volts

ΔT=25 μsec

1H=50 μsec

As a result, a good halftone display was performed at a frame frequency of ca. 33 Hz, and the partial rewrite was made possible at a frequency of ca. 67 Hz with no flicker and good mouse response.

(Experimental Example 2)

A liquid crystal display device of 640×400 pixels was similarly constituted and driven by the drive scheme described with reference to FIG. 37 by using a set of drive signal shown in FIG. 12 with the following parameters.

V1=25 volts

V2=−17 volts

V3=7.7 volts

V4=7 volts

V5=−7 volts

ΔT=20 μsec

1H=40 μsec

As a result, a good halftone display was performed at a frame frequency of ca. 20 Hz, and the partial rewrite was made possible at a frequency of ca. 80 Hz with no flicker and good mouse response.

Figure 38:
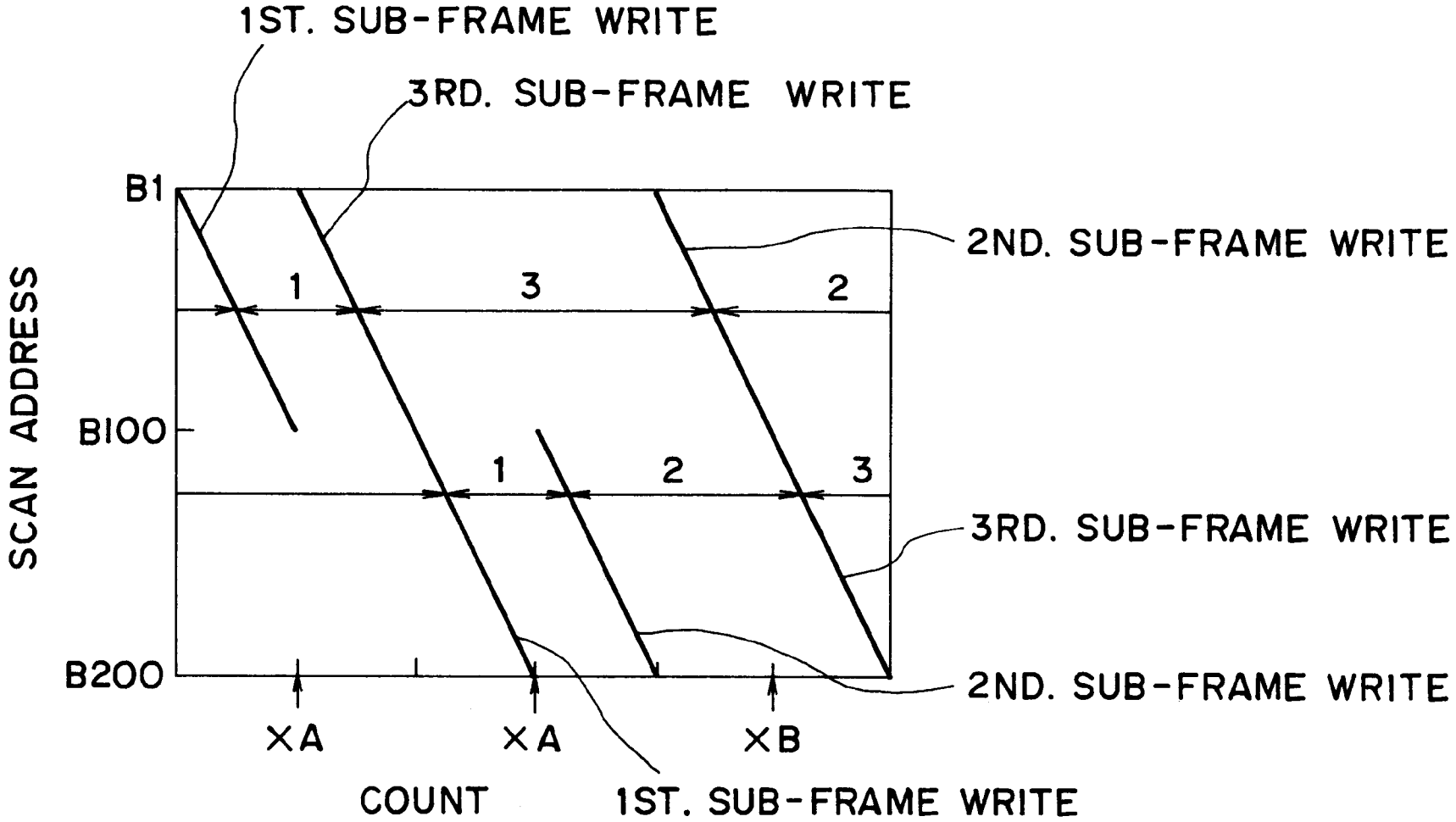

FIG. 38 is a scanning chart for illustrating another frame modulation scheme, wherein one frame is constituted by three sub-frames giving ratios of display periods of 1:2:3. One frame is divided into 6 consecutive blocks to which an equal selection time is allotted.

Each block is allotted with a selection time for a group of adjacent 100 scanning lines, and the 100 scanning lines in the group are successively selected, within the block. For example, in the 1st block, the scanning lines B1–B100 are selected one by one. The selection may be performed either sequentially in the order of addresses, such as B1, B2, B3, . . . B100, or may be in a random order of, e.g., B1, B100, B2, B99, . . . B50. In the case of such a random order, the selected random order should be observed also in a subsequent sub-frame.

In this scanning scheme, different order of weights of sub-frames are set to different groups of scanning lines, e.g., the order of weights of sub-frames for the first group including scanning lines B1–B100 is 1, 3, 2, 1, 3, 2, . . . and 1, 2, 3, 1, 2, 3, . . . for the group of scanning lines B101–B200 as shown in FIG. 38.

In order to combine the above-mentioned frame modulation scheme, a partial rewrite period may be inserted at places of arrow XA and/or a place of arrow XB. In this case, the division ratios of sub-frames can be different so that the number of scanning lines selected in the respective blocks may be appropriately set so as to provide a desired sub-frame division ratio.

As described above, in the present invention, one frame is divided into a whole picture scanning period and a partial rewriting period so that, in the partial rewriting period, only certain scanning electrodes required for changing a display state are scanned, thereby allowing a partial rewrite in a shorter cycle than the frame cycle. As a result, the lowering in image quality can be suppressed to allow a better quality of halftone display compared with the case where a partial rewrite is performed by interrupting a whole picture scanning when a change in display content occurs. Further, it becomes possible to provide an enhanced responsiveness to a change in display content.

Further, if an almost identical gradational display is performed both in the whole picture scanning period and in the partial rewrite period an operator can easily recognize what level of gradation is displayed, and it becomes possible to prevent the occurrence of flicker due to a difference in gradation.

What is claimed is:

1. A display apparatus comprising:

a display panel comprising a pair of oppositely disposed substrates having thereon a plurality of scanning electrodes and a plurality of data electrodes, and an optical modulation substance disposed between the substrates so as to form a pixel at each intersection of said scanning electrodes and said data electrodes; and drive means for driving said display panel so that a period of each pixel being placed in a prescribed display state is determined within a frame period depending on given gradation data, said drive means further dividing one frame period into a first plurality of equivalent blocks of which a second plurality, smaller in number than the first plurality, of mutually non-neighboring blocks are allotted to a partial rewriting for selecting scanning electrodes corresponding to pixels to change display states, and the remaining blocks other than the second plurality of blocks within the first plurality of blocks are allotted to an entire picture scanning for selecting all the scanning electrodes, during the entire picture scanning, subjecting each scanning electrode to a plurality of selections including a first selection and a second selection within one frame period while setting an interval from the first to the second selection of each scanning electrode so as to provide a first prescribed ratio of the interval to said one frame period, and during the partial rewriting, subjecting an identical scanning electrode to a plurality of selections including a first selection and a second selection within one block while setting an interval from the first to the second selection of the identical scanning electrode so as to provide a second prescribed ratio of the interval to said one block period, the second prescribed ratio being identical to said first prescribed ratio during the entire picture scanning, thereby allowing display of an identical number of gradation levels both in the entire picture scanning and in the partial rewriting.

2. A display apparatus according to claim 1, wherein the one frame period is divided to include a plurality n of sub-frames having durations suitable for displaying $2^n$ gradations in the entire picture scanning period, wherein n denotes a positive integer.

3. A display apparatus according to claim 1, wherein the one frame period is divided to include a plurality n of sub-frames having durations suitable for displaying $2^n$ gradations in the partial rewrite period, wherein n denotes a positive integer.

4. An apparatus according to claim 3, wherein a first ratio of the interval from the first to the second selection to an interval from the second to a subsequent first selection in the entire scanning is identical to a second ratio of the interval from the first to the second selection to an interval from the second to a subsequent first selection in the partial rewriting.

5. A display apparatus according to claim 1, wherein interlaced scanning is performed in the entire picture scanning period.

6. A display apparatus according to claim 1, wherein said optical modulation substance comprises a ferroelectric liquid crystal.

7. A data processing apparatus, including:

a graphic controller for outputting data signals and a scanning scheme signal;

a scanning signal control circuit for outputting scanning line address data and a scanning scheme signal;

a data signal control circuit for outputting display data and a scanning scheme signal; and a display apparatus comprised of:

a display panel including a pair of oppositely disposed substrates having thereon a plurality of scanning electrodes and a plurality of data electrodes, and an optical modulation substance disposed between the substrates so as to form a pixel at each intersection of said scanning electrodes and said data electrodes; and drive means for driving said display panel so that a period of each pixel being placed in a prescribed display state is determined within a frame period depending on given gradation data, said drive means further dividing one frame period into a first plurality of equivalent blocks of which a second plurality, smaller in number than the first plurality, of mutually non-neighboring blocks are allotted to a partial rewriting for selecting scanning electrodes corresponding to pixels to change display states, and the remaining blocks other than the second plurality of blocks within the first plurality of blocks are allotted to an entire picture scanning for selecting all the scanning electrodes, during the entire picture scanning, subjecting each scanning electrode to a plurality of selections including a first selection and a second selection within one frame period while setting an interval from the first to the second selection of each scanning electrode so as to provide a first prescribed ratio of the interval to said one frame period, and during the partial rewriting, subjecting an identical scanning electrode to a plurality of selections including a first selection and a second selection within one block while setting an interval from the first to the second selection of the identical scanning electrode so as to provide a second prescribed ratio of the interval to said one block period, the second prescribed ratio being identical to said first prescribed ratio during the entire Picture scanning, thereby allowing display of an identical number of gradation levels both in the entire picture scanning and in the partial rewriting.

* * * * *

UNITED STATES PATENT AND TRADEMARK OFFICE

CERTIFICATE OF CORRECTION

PATENT NO. : 6,057,824

DATED : May 2, 2000

INVENTOR(S): KAZUNORI KATAKURA, ET AL.

It is certified that error appears in the above-identified patent and that said Letters Patent is hereby corrected as shown below:

[56] REFERENCES CITED:

FOREIGN PATENT DOCUMENTS, "5127623 5/1993 Japan" should read --5-127623 5/1993 Japan--.

SHEET 17:

FIG. 24, "1ST. SUB-FRAM" should read --1ST. SUB-FRAME--; and "2ND. SUB-FRAM" should read --2ND. SUB-FRAME--.

SHEET 25:

FIG. 32, "DISPLAY DEGION" should read --DISPLAY REGION--.

Figure 34:
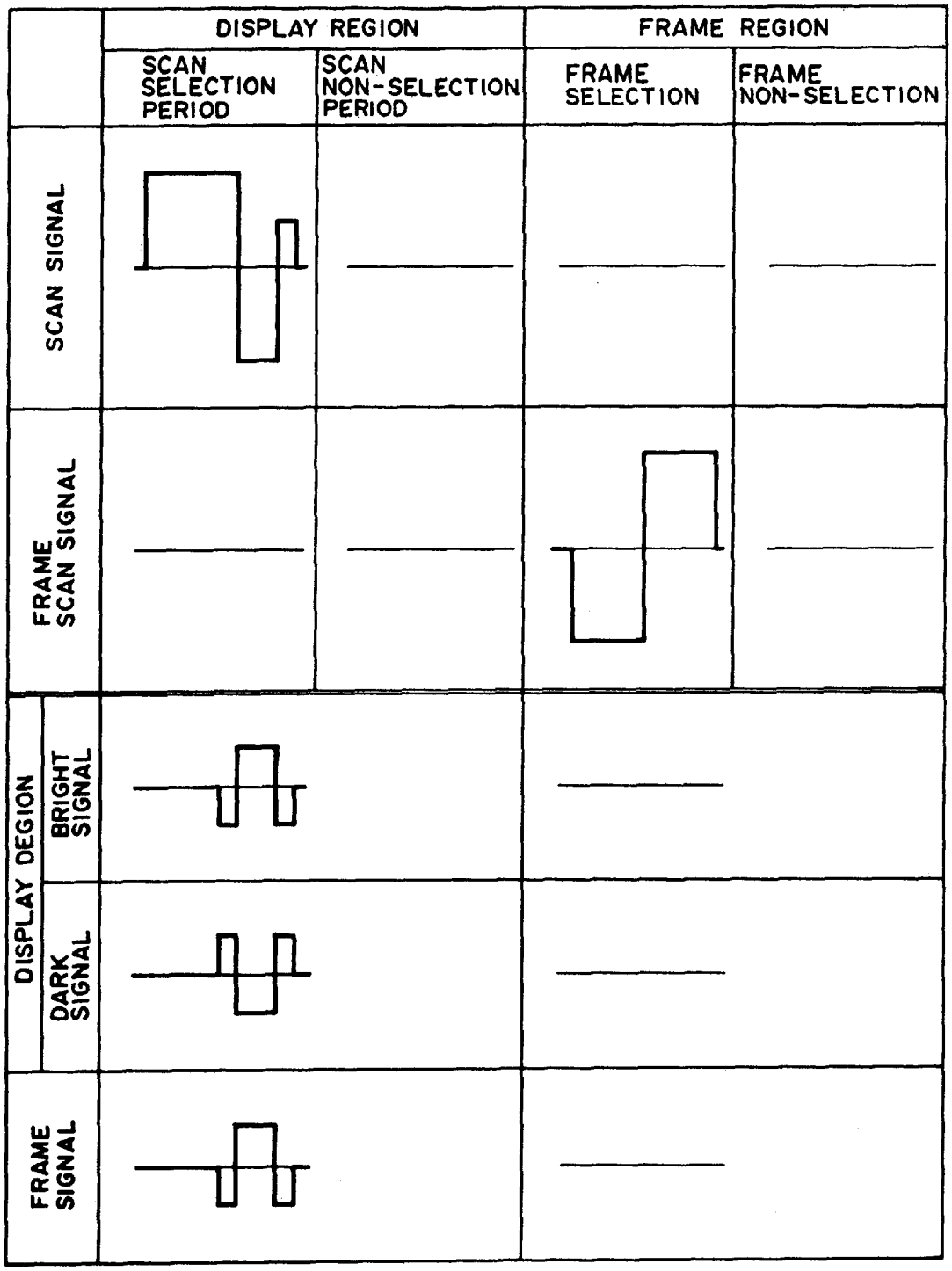

SHEET 27:

FIG. 34, "DISPLAY DEGION" should read --DISPLAY REGION--.

COLUMN 2:

Line 44, "sub-frame" should read --sub-frames--.

COLUMN 4:

Line 50, "hanging" should read --changing--.

UNITED STATES PATENT AND TRADEMARK OFFICE

CERTIFICATE OF CORRECTION

PATENT NO. : 6,057,824

DATED : May 2, 2000

INVENTOR(S): KAZUNORI KATAKURA, ET AL.

It is certified that error appears in the above-identified patent and that said Letters Patent is hereby corrected as shown below:

COLUMN 9:

Line 20, "waveform (a) FIG. 13," should read --waveform (a) in FIG. 13,--.

COLUMN 11:

Line 4, "rewritten FIG. 16" should read --rewritten. FIG. 16--.

COLUMN 23:

Line 42, "claim 1," should read --claim 2,--.

COLUMN 24:

Line 50, "Picture" should read --picture--.

Signed and Sealed this

Tenth Day of April, 2001

*Attest:*

Nicholas P. Godici

NICHOLAS P. GODICI

*Attesting Officer*

*Acting Director of the United States Patent and Trademark Office*